US006754461B2

(12) United States Patent
Hoshi et al.

(10) Patent No.: US 6,754,461 B2
(45) Date of Patent: Jun. 22, 2004

(54) DEVELOPER CHARGING DEVICE

(75) Inventors: Nobuharu Hoshi, Shizuoka (JP); Kenji Matsuda, Shizuoka (JP); Akiyoshi Fujita, Shizuoka (JP)

(73) Assignee: Canon Kabushiki kaisha, Tokyo (JP)

( * ) Notice: Subject to any disclaimer, the term of this patent is extended or adjusted under 35 U.S.C. 154(b) by 0 days.

(21) Appl. No.: 10/235,814

(22) Filed: Sep. 6, 2002

(65) Prior Publication Data

US 2003/0049049 A1 Mar. 13, 2003

(30) Foreign Application Priority Data

Sep. 13, 2001 (JP) ..... 2001-277774
Nov. 27, 2001 (JP) ..... 2001-360748
Nov. 30, 2001 (JP) ..... 2001-367718

(51) Int. Cl.[7] ..... G03G 15/02; G03G 21/00
(52) U.S. Cl. ..... 399/129; 399/175
(58) Field of Search ..... 399/127–129, 399/149, 150, 71, 98, 174–176, 343, 349, 353; 15/256.5, 256.53; 430/902; 361/221, 225

(56) References Cited

U.S. PATENT DOCUMENTS 5,060,016 A * 10/1991 Wanou et al. ..... 399/175
5,245,386 A * 9/1993 Asano et al. ..... 399/175
5,323,215 A * 6/1994 Ohtaka et al. ..... 399/150 X
5,398,102 A * 3/1995 Wada et al. ..... 399/174
5,630,199 A * 5/1997 To ..... 399/175
5,754,926 A * 5/1998 Sakuraba et al. ..... 399/175
5,784,673 A * 7/1998 Terada et al. ..... 399/149
6,144,824 A * 11/2000 Hashimoto et al. ..... 399/128
6,215,967 B1 * 4/2001 Takeda et al. ..... 399/149 X
6,219,509 B1 * 4/2001 Komiya et al. ..... 399/175 X
6,229,979 B1 5/2001 Ishii et al. ..... 399/281
6,298,203 B1 10/2001 Hashimoto et al. ..... 399/119

FOREIGN PATENT DOCUMENTS

GB 2 129 372 * 5/1984
JP 06-051609 * 2/1994
JP 8-137368 5/1996
JP 08-305127 * 11/1996

* cited by examiner

*Primary Examiner*—Sophia S. Chen
(74) *Attorney, Agent, or Firm*—Fitzpatrick, Cella, Harper & Scinto

(57) ABSTRACT

A developer charging device for charging developer with electricity includes a developer charging member a reciprocating unit, and an attitude maintaining unit. The developer charging member is arranged at a position downstream relative to a transfer device transferring a developer image from an image carrier to an image receiving member and upstream relative to a charging device for electrically charging the image carrier as viewed in the moving direction of the image carrier. The developer charging member is held in contact with the image carrier so as to electrically charge residual developer on the image carrier. The reciprocating unit reciprocates the developer charging member in a direction of a generating line of the image carrier. The attitude maintaining unit maintains an attitude of the developer charging member relative to the image carrier regardless of a reciprocation of the developer charging member by the reciprocating unit. The attitude maintaining unit includes at least one spacer arranged in contact with the image carrier in order to maintain a positional relationship between the developer charging member and the image carrier.

38 Claims, 22 Drawing Sheets

DEVELOPER CHARGING DEVICE

BACKGROUND OF THE INVENTION

1. Field of the Invention

This invention relates to a developer charging device adapted to be used typically for an electrophotography type image forming apparatus. More particularly, it relates to a developer charging device for electrically charging the residual developer on an image carrier.

The expression of image forming apparatus as used herein refers to an apparatus adapted to form an image on a transfer material (such as paper or transparent film) as a recording medium by way of an electrophotographic image forming process. Image forming apparatus include electrophotographic copying machines, electrophotographic printers (such as LED printers and laser beam printers), electrophotographic facsimile machines and electrophotographic word processors.

2. Related Background Art

The process cartridge system is known for printers, copying machines and facsimile machines of the electrophotography type. With the process cartridge system, an electrophotographic photosensitive member (to be referred to as "photosensitive drum" hereinafter), a primary charger, a developing unit and a cleaning unit are integrally combined along with other elements and put into a container to form a process cartridge, which is then removably fitted to an image forming apparatus main body.

The process cartridge system remarkably improved the operating efficiency of electrophotographic machines of the above identified type because the user of such a machine can service the process means of machine so that, as a result, the process cartridge system has become very popular. A process cartridge comprises as integral parts thereof at least one of a charging device, a developing unit or a cleaning unit and an electrophotographic photosensitive member, which is an image carrier, and can be removably fitted to an image forming apparatus main body.

A charging device is adapted to uniformly charge an electrophotographic photosensitive member with electricity to make it show a predetermined polarity and a predetermined electric potential.

Cartridges designed so as to comprise respective groups of process means that are sorted according to their service lives have been realized in order to allow each cartridge to enjoy the full service life of its own main process means. For instance, development cartridges comprising a toner containing section and a developing unit as integral parts thereof and drum cartridges comprising a photosensitive drum, a primary charger and a cleaning device as integral parts thereof are currently available.

Meanwhile, so-called cleanerless systems that do not use any dedicated cleaning device have been proposed in recent years. With an image forming apparatus, a toner image (an image formed by a developer) that corresponds to the image information given to it is formed by applying an image forming process including a step of uniformly charging the photosensitive drum with electricity, and the obtained toner image is transferred onto a transfer material such as paper or transparent film. With the cleanerless system, the toner image left on the photosensitive drum (residual toner) is removed from the latter and collected for reuse by cleaning the photosensitive drum at the time of developing the image by means of the developing unit. Then, it is possible to down-size image forming apparatus employing such a system because the cleanerless system does not involve the use of a cleaning device.

For example, Japanese Patent Application Laid-Open Publication No. 8-137368 proposes an image forming apparatus and a process cartridge that are of the cleanerless type and comprise a toner charge control means (developer charging member) arranged at a position downstream relative to the transfer charger and upstream relative to the primary charger as viewed in the rotary direction of the photosensitive drum and adapted to unify the polarities of the electric charge of the residual toner remaining on the photosensitive drum to a correct one after the transferring step so as to prevent the contact charge members of the primary charger from being smeared by the residual toner and fogged images from appearing due to a defective electric charge.

The toner charge control means as disclosed in the above identified patent document is provided with a stationary blush-shaped section that is an appropriate conductor of electricity. However, the toner charge control means can show a drawback that the residual toner is locally excessively charged if the charge of the residual toner is controlled to a proper level with the right polarity by it. Once an excessive charge appears on the residual toner, the latter no longer adheres to the contact charge members nor is collected in the developing unit because the mirror-reflection effect is too strong between the photosensitive drum and the excessively charged residual toner. Then, it is no longer possible to transfer the toner image on the transfer material by the transfer charger. As a result, the excessively charged residual toner can be fused to adhere onto the photosensitive drum and produce defective images.

It has been found that the above identified situation occurs because the stationary brush member that operates as toner charge control means is continuously held to a same position on the photosensitive drum. When the toner charge control means shows an uneven resistance, an excessive or insufficient electric charge appears at one or more than one same spots on the photosensitive drum. The problem of local excessive charge and fusion of residual toner takes place at excessively charged spots, whereas the problem of smeared contact charge members appears at insufficiently charged spots because the residual toner cannot be charged sufficiently.

Meanwhile, as a result of diversified users' needs in recent years, a large volume of residual toner can be produced at a time particularly when photographic images that show a high printing ratio are continuously printed or when color images are printed by using a multiple developing process on the photosensitive drum so that consequently the above problems can become very remarkable.

SUMMARY OF THE INVENTION

In view of the above identified circumstances, it is therefore an object of the present invention to provide a developer charging device that can correctly and properly charge the residual developer.

Another object of the present invention is to provide a developer charging device that can prevent defective charges and defective images from being produced by the residual developer.

Still another object of the present invention is to provide a developer charging device that can effectively spread the residual developer.

Still another object of the present invention is to provide a developer charging device that can reciprocate the developer charging member in the generating line direction of the image carrier.

A further object of the present invention is to provide a developer charging device that can maintain the proper and correct positional relationship between the developer charging member and the image carrier.

Other objects and characteristic aspects of the present invention will become apparent from the detailed description given below by referring to the accompanying drawings.

DESCRIPTION OF THE PREFERRED EMBODIMENTS

Now, the present invention will be described by referring to the accompanying drawings that illustrate preferred embodiments of the invention. Throughout the drawings, same members and devices are denoted respectively by the same reference symbols and will not be described repeatedly unless necessary.

In the following description, the direction of the axial line (generating line) of the photosensitive drum is referred to as axial direction or longitudinal direction. The axial direction rectangularly intersects the direction in which the transfer material is moved. The expressions of left and right refer respectively to the left and right sides as viewed from the upstream side of the direction in which the transfer material is moved. The expressions of upper/above and lower/below refer respectively to the upper side and the lower side when the process cartridge is mounted in position.

<Embodiment 1>

Figure 1:
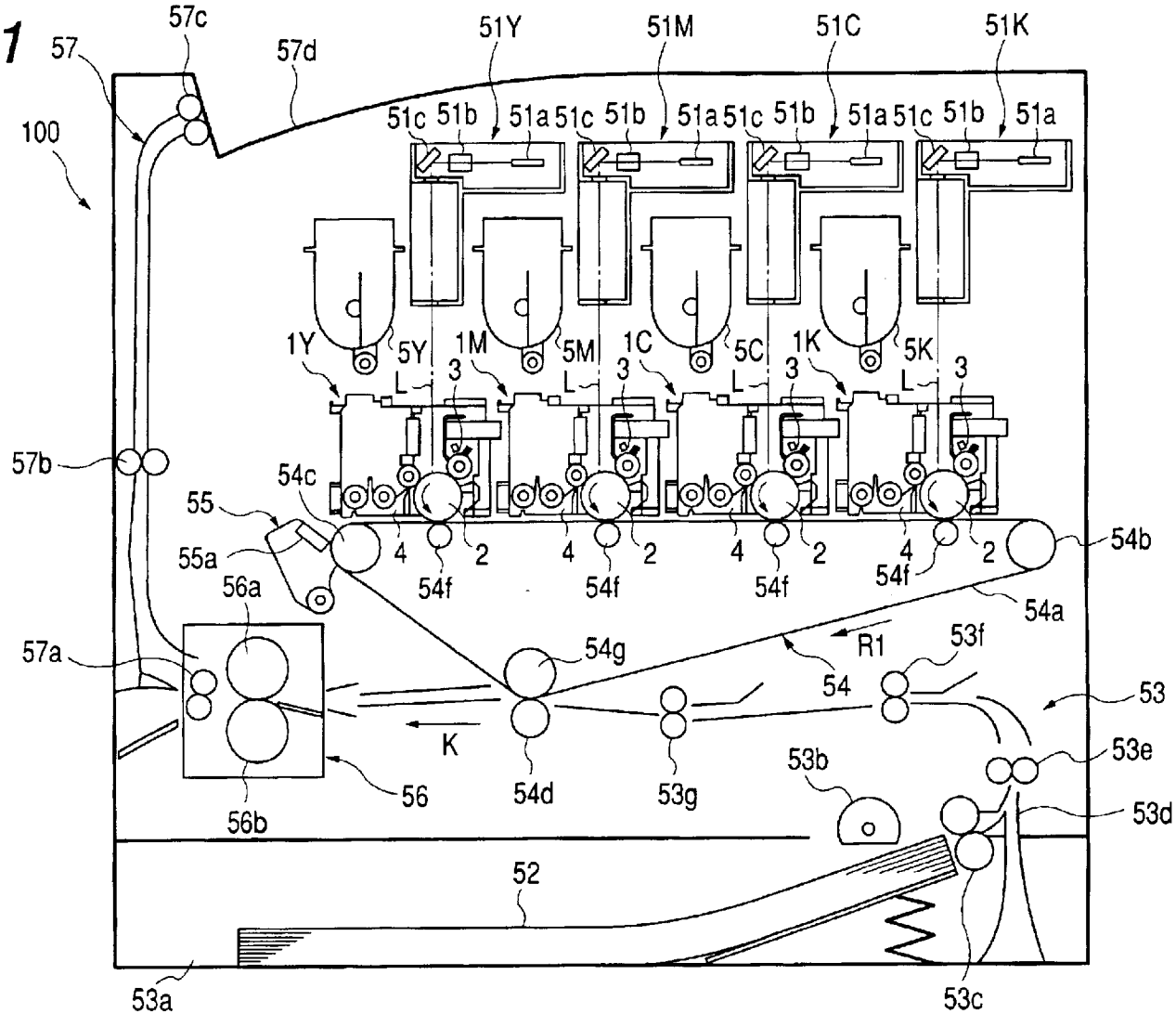
FIG. 1 is a schematic longitudinal cross sectional view of an image forming apparatus to which this invention is applicable.

FIG. 1 schematically illustrates an image forming apparatus to which this invention is applicable. The image forming apparatus of FIG. 1 is an electrophotography type full-color laser beam printer that uses four colors.

Entire Image Forming Apparatus

Firstly, the entire image forming apparatus as shown in FIG. 1 will be summarily described.

Referring to FIG. 1, the image forming apparatus has an image forming section that comprises four process cartridges including an yellow process cartridge 1Y, a magenta process cartridge 1M, a cyan process cartridge 1C and a black process cartridge 1K, each having a drum-shaped electrophotographic photosensitive member (hereinafter referred to as "photosensitive drum") 2 as an image carrier, and four laser scanners 51Y, 51M, 51C and 51K of the four colors arranged above the respective process cartridges 1Y, 1M, 1C and 1K and adapted to operate as exposure devices (exposure means). Any of the process cartridges, the laser scanners and other color-related members of the apparatus will be referred to simply as, for example, "process cartridge 1" or "laser scanner 51" when it is not necessary to discriminate it by color.

A conveyor/feeder means 53 for conveying/feeding a transfer material 52 and an intermediate transferring unit 54 that operates as transfer means are arranged below the image forming section. For the purpose of the invention, the transfer material 52 may be ordinary paper that is popularly being used for copies, OHP sheets of transparent film typically being used for overhead projectors, woven or unwoven cloth or some other appropriate material. The intermediate transferring unit 54 is provided with an intermediate transfer belt 54*a* that operates as image receiving member and a secondary transferring roller 54*d* adapted to transfer the toner image on the intermediate transfer belt 54*a* onto the transfer material 52.

Additionally, a fixing device (fixing means) 56 for fixing the toner image transferred onto the transfer material 52 and a discharging means 57 for discharging the transfer material 52 after fixing the toner image on the latter are arranged downstream relative to the secondary transferring roller 54*d* as viewed in the direction of transporting the transfer material 52 (as indicated by arrow K in FIG. 1).

The image forming apparatus of this embodiment is of the cleanerless type and the residual toner left on the photosensitive drums 2 is taken into the developing device (developing means). In other words, no cleaner dedicated to collecting and storing residual toner is arranged in the process cartridges.

Now, the members, the devices and the means of the above described image forming apparatus will be sequentially described in greater detail.

Conveyor/feeder Means

The conveyor/feeder means 53 is adapted to convey/feed the transfer material 52 to the image forming section and comprises a sheet feeding cassette 53*a* containing a plurality of sheets of the transfer material 52, a feed roller 53*b*, a retard roller 53*c* for preventing more than one sheets from being transported at a time, a feed guide 53*d*, convey rollers 53*e*, 53*f* and a registration roller 53*g*.

The feed roller 53*b* is driven to rotate in response to an image forming operation so as to isolate a sheet of the transfer material 52 in the sheet feeding cassette 53*a* and send it out. A required number of sheets will be fed on a one by one basis in this way. The transfer-material 52 is guided by the feed guide 53*d* and conveyed to the registration roller 53*g* by the convey rollers 53*e*, 53*f*. The rotary motion of the registration roller 53*g* is suspended immediately after the transfer material 52 is sent out and the askance running motion, if any, of the transfer material 52 is corrected as the transfer material 52 abuts the nip section of the registration roller 53*g*. During the image forming operation, the registration roller 53*g* shows a non-rotary motion for holding the transfer material 52 in a stationary stand-by state and a rotary motion for conveying the transfer material 52 toward the intermediate transfer belt 54*a* according to a predetermined sequence and aligns the transfer material 52 with the toner image for the next step, which is a transferring step.

Process Cartridge

Figure 2:
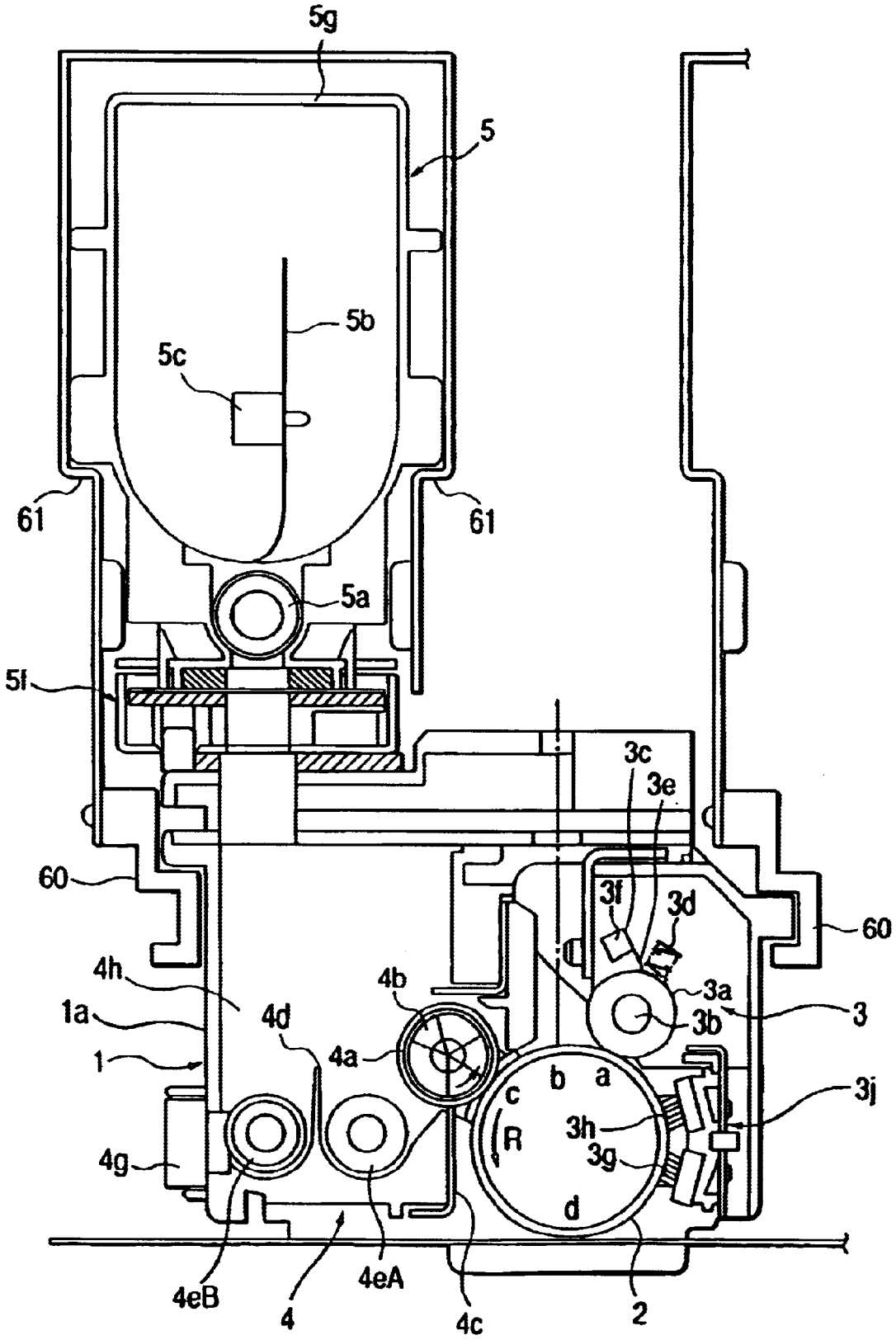
FIG. 2 is a schematic longitudinal cross sectional view of one of the process cartridges and a corresponding toner supply container of the apparatus of FIG. 1.

As shown in FIG. 2 (an enlarged view of one of the process cartridges in FIG. 1), each process cartridge 1 is mounted in a cartridge container 1*a* integrally with a photosensitive drum 2, which is an image carrier, a primary charger 3, which is a charging device (charging means), and a developing device (developing means) 4, the primary charger 3 and the developing device 4 being arranged around the photosensitive drum 2. The process cartridges 1 are removably fitted to the main body 100 of the image forming apparatus so that they can be individually mounted into and removed from the main body without difficulty. Therefore, when any of the photosensitive drums 2 comes to end its service life, the user can easily replace it with a new one.

In this embodiment, the number of revolutions of each of the photosensitive drums 2 is counted and the corresponding process cartridge 1 reports the end of the service life of the photosensitive drum 2 when a predetermined number of revolutions is counted.

Each of the photosensitive drums 2 of this embodiment is formed by arranging an OPC (organic photo-semiconductor) photosensitive layer that shows a negative charge characteristic on a drum base member made of aluminum and having a diameter of about 30 mm. The photosensitive layer includes an outermost charge injection layer, which is a coat layer made of a binder material and typically containing super-micro particles of $SnO_2$ dispersed in it as electroconductive micro particles.

Each of the photosensitive drums 2 is driven to rotate at a predetermined process speed (about 117 mm/sec in this embodiment) in the direction of arrow R in FIG. 2.

Figure 4:
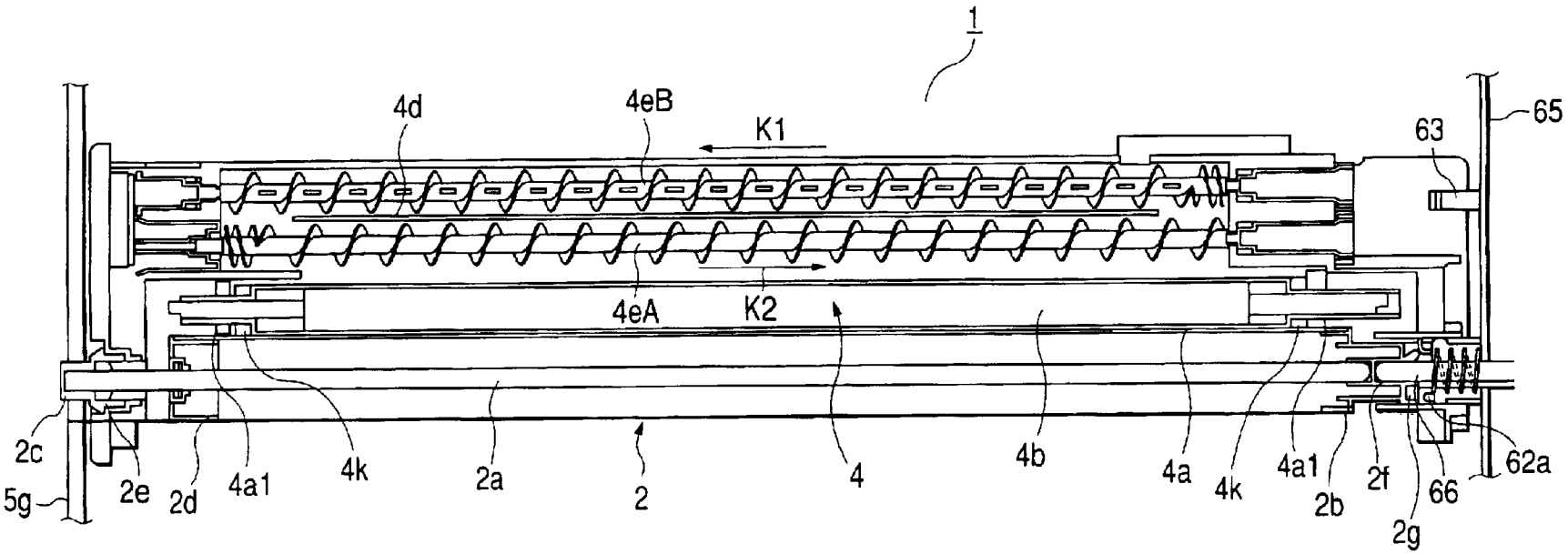
FIG. 4 is a schematic cross sectional view of the apparatus of FIG. 1 taken along a line running through the axes of one of the photosensitive drums, the corresponding charging roller and the corresponding agitating screw.

As shown in FIG. 4 (a cross sectional view of the apparatus of FIG. 1 taken along a line running through the axes of one of the photosensitive drums, the corresponding charging roller and the corresponding agitating screw), a drum flange (drive flange) 2*b* is rigidly secured to the remote end (the right end in FIG. 4) of the photosensitive drum 2 while a follower flange 2*d* is rigidly secured to the near end (the left end in FIG. 4) of the photosensitive drum 2. A drum shaft 2*a* runs through the center of the drum flange 2*b* and that of the follower flange 2*d*. Thus, the drum shaft 2*a*, the drum flange 2*b* and the follower drum flange 2*d* are integrally driven to rotate. In other words, the photosensitive drum 2 is driven to rotate around the drum shaft 2*a*. The near end of the drum shaft 2*a* is received by a bearing 2*e* so as to allow the drum shaft 2*a* to freely rotate. The bearing 2*e* is rigidly secured relative to the bearing case 2*c*, which bearing case 2*c* is by turn rigidly secured relative to the frame of the process cartridge 1.

Primary Charger (Charging Device)

Each of the primary chargers (charging devices) 3 that operates as charging means is based on a contact charge process. In this embodiment, it comprises a charging roller 3*a* that operates as charging member and held in contact with the corresponding photosensitive drum 2 as shown in FIG. 2.

The charging roller 3*a* has a core metal 3*b* that is rotatably held at opposite ends thereof by respective bearing members (not shown) and is urged to abut and press the surface of the photosensitive drum 2 by a pressure spring 3*d* under predetermined pressure. Thus, the charging roller 3*a* rotates to follow the rotary motion of the photosensitive drum 2.

A charging roller cleaning member 3*c* formed by using flexible cleaning film 3*e* is arranged so as to abut the surface of the charging roller 3*a*. The cleaning film 3*e* is arranged in parallel with the longitudinal direction of the charging roller 3*a* and its upper end is rigidly secured to a support member 3*f* that reciprocates by a given distance relative to the longitudinal direction, while its lower end is free end that abuts the surface of the charging roller 3*a* to form a contacting nip section relative to the surface of the photosensitive drum 2. As the support member 3*f* is driven to reciprocate by a given distance in the longitudinal direction, the cleaning film 3*e* scrapes the surface of the charging roller 3*a* to remove the objects (fine toner particles, extraneous additives, etc.) adhering to the surface of the charging roller. The cleaning film 3*e* is preferably made of resin and adapted to frictionally charge the toner adhering to the roller surface to the proper polarity (negative polarity). The toner that recovered the proper polarity is then returned from the charging roller 3*a* to the photosensitive drum 2.

The primary charger 3 will be described in greater detail hereinafter.

The image forming apparatus of this embodiment adopts a cleanerless system, which will be described below.

Cleanerless System

Now, the cleanerless system of the image forming apparatus of this embodiment will be summarily described. It is designed to bring the residual toner remaining on the photosensitive drum 2 after a toner image transfer operation, due to the rotation motion of the drum to the developing section (developing position) c by way of the charging section (charging position) a and the exposure section (exposure position) b and subject it to a cleaning (collecting) operation that proceeds at the developing device (developing means)

4 simultaneously with developing operation. More specifically, a developing electric field is formed to cause toner to adhere to the light areas of the photosensitive drum 2 from the developing device 4 and, simultaneously, a toner retrieving electric field is formed to collect toner from the dark areas of the photosensitive drum 2 to the developing device 4. Note that the transfer section (transfer position) is denoted by d in FIG. 2.

Since the residual toner on the photosensitive drum 2 is made to pass by the exposure section b, the exposure step proceeds with the residual toner. However, since the volume of the residual toner is very small, the exposure step is not significantly affected by the residual toner. However, it should be noted that, the residual toner remaining after the transfer operation may partly show the opposite polarity (polarity-inverted toner), rather than the proper polarity, and/or partly be charged insufficiently so that, if polarity-inverted toner and/or insufficiently charged toner passes by the charging section a, it may adhere to the charging roller 3*a* to contaminate the charging roller 3*a* above a permissible level and give rise to a defective charge.

For the developing device 4 to effectively carry out the cleaning operation of removing the residual toner from the surface of the photosensitive drum 2 simultaneously with the developing operation, it is necessary that the electric charge of the residual toner on the photosensitive drum 2 that is brought back to the developing section c shows the proper polarity at a level adapted for effecting the operation of developing the electrostatic latent image on the photosensitive drum 2. Of the residual toner, polarity-inverted toner and inappropriately charged toner cannot be removed and collected by the developing device 4 from the photosensitive drum 2 and can produce a defective image.

Meanwhile, as a result of diversified users' needs in recent years, a large volume of residual toner can be produced at a time particularly when photographic images that show a high printing ratio are continuously printed (continuous image forming operation) on the photosensitive drum so that consequently the above problems can become very remarkable.

In view of this problem, in this embodiment, a residual toner equalizing means (developer dispersing member) 3*g* is arranged at a position downstream relative to the transfer section d and upstream relative to the charging section a as viewed in the direction of rotation of the photosensitive drum 2 (as indicated by arrow R in FIG. 2) in order to equalize the residual toner on the photosensitive drum 2 and a toner (developer) charge control means (developer charging member) 3*h* is arranged at a position downstream relative to the residual toner equalizing means 3*g* and upstream relative to the charging section a in order to make the residual toner show the proper charge polarity, which is the negative polarity. Note that both the residual toner equalizing means 3*g* and the toner charge control means 3*h* extend substantially along the entire longitudinal (axial) length of the photosensitive drum 2.

Due to the provision of the residual toner equalizing means 3*g*, the residual toner on the pattern formed on the photosensitive drum 2, which is to be moved from the transfer section d to the toner charge control means 3*h*, is dispersed and distributed over the entire surface (in the axial and peripheral directions) of the drum 2 to wipe off the pattern if it has a large quantity so that toner will not concentrate in part of the toner charge control means 3*h* and hence the latter can constantly and satisfactorily operate to make the entire residual toner show the proper polarity and prevent the residual toner from adhering to the charging roller 3*a*. Additionally, a ghost image of the patterned residual toner is prevented from appearing.

In this embodiment, both the residual toner equalizing means 3*g* and the toner charge control means 3*h* are realized in the form of brush-shaped members showing an appropriate level of electro-conductivity. They respectively have brush sections 3*ga*, 3*ha* and base sections 3*gb*, 3*hb* holding the brush sections 3*ga*, 3*ha*. The brush sections 3*ga*, 3*ha* are formed by implanting electro-conductive filaments. Preferably, a voltage showing the (positive) polarity opposite to the proper polarity of toner is applied to the brush section 3*ga* so that the entire residual toner may be positively charged by it. Preferably, a voltage showing the proper (negative) polarity of toner is applied to the brush section 3*ha* so that the entire residual toner may be negatively charged by it to show the proper polarity of toner. As the residual toner is charged to show the proper polarity of toner, it is effectively collected to the developing device 4 and prevented from adhering to the charging roller 3*a*. The brush sections 3*ga*, 3*ha* of the residual toner equalizing means 3*g* and the toner charge control means 3*h* are respectively held by brush bases 11*a*, 11*b* that are rigidly secured to base frame 12*a* so that each filament may be directed generally toward the center of the photosensitive drum 2. The base frame 12*a* and the brush bases 11*a*, 11*b* constitute a support member 12. The brush sections 3*ga*, 3*ha* are held to abut the surface of the photosensitive drum 2 in such a way that they bite the surface of the photosensitive drum 2 to respective extents X1, X2. The lengths of bite X1, X2 will be described hereinafter.

The residual toner equalizing means 3*g* and the toner charge control means 3*h* are adapted to be driven to move (reciprocate) in the longitudinal direction of the photosensitive drum 2 by a drive means (not shown). With this arrangement, the residual toner equalizing means 3*g* and the toner charge control means 3*h* do not remain stationary at the same respective positions on the surface of the photosensitive drum 2. Therefore, if the surface of the photosensitive drum 2 produces excessively charged areas and/or insufficiently charged areas due to an uneven resistance of the toner charge control means 3*h*, for instance, they do not remain at the same positions so that fusion and adhesion of toner to the surface of the photosensitive drum 2 due to an excessive charge of the residual toner in small (local) areas and adhesion of toner to the charging roller 3*a* due to an insufficient charge of the residual toner can be effectively suppressed or prevented.

Exposure Device (Exposure Means)

In this embodiment, laser scanners 51Y, 51M, 51C and 51K as shown in FIG. 1 are used as exposure device (exposure means) for exposing the photosensitive drum 2 to light. More specifically, as an image signal is transmitted from the image forming apparatus main body 100, a laser beam L that is modulated in response to the signal is made to scan the surface of the electrically charged photosensitive drum 2 for exposure. As a result of the exposure, the electric charge is selectively removed from the exposed areas of the surface of the photosensitive drum 2 to produce an electrostatic latent image that corresponds to the applied image information on the surface of the photosensitive drum 2. Each of the laser scanners 51 comprises a solid state laser element (not shown), a polygon mirror 51*a*, a focusing lens 51*b* and a reflection mirror 51*c*. The solid state laser element is turned ON/OFF by a light emission signal generator (not shown) according to the input image signal at predetermined timings to emit a laser beam in a controlled manner. The laser beam L emitted from the solid state laser element is turned into a substantially parallel flux of light by a collimator lens system (not shown), scanned by the polygon mirror 51*a* rotating at a high speed, and focused to form a light spot on the surface of the photosensitive drum 2 by way of the focusing lens 51*b* and the reflection mirror 51*c*. In this way, the surface of the photosensitive drum 2 is exposed to a laser beam both in the main scanning direction of the laser beam and also in the sub-scanning direction due to the rotation of the photosensitive drum 2 in the direction indicated by the arrow R in FIG. 2 to produce an exposure distribution pattern that corresponds to the image signal. In other words, a light portion potential where the surface potential is made to fall and a dark portion potential where the surface potential is not made to fall are produced by the irradiation (or non-irradiation) of the laser beam L. Thus, an electrostatic latent image that corresponds to the applied image information is formed due to the contrast between the light portion potential and the dark portion potential.

Developing Device (Developing Means)

The developing device 4, or the developing means, is of the dual-component contact development type (dual-component magnetic brush developing device) and holds the developer mainly consisting of carrier and toner in a developing sleeve (developer carrier) 4*a* that contains a magnet roller 4*b* as shown in FIG. 2. A regulating blade 4*c* is arranged near the developing sleeve 4*a* with a predetermined distance separating them from each other so that the regulating blade 4*c* is adapted to form a thin layer of developer on the surface of the developing sleeve 4*a* as the latter is driven to rotate in the direction indicated by the corresponding arrow shown in FIG. 2.

As shown in FIG. 4, the developing sleeve 4*a* has journal sections 4*a*1 having a reduced diameter at the opposite ends thereof, to which spacers 4*k* are rotatably fitted to separate the developing sleeve 4*a* from the photosensitive drum 2 by a predetermined gap. With this arrangement, the developer layer formed on the developing sleeve 4*a* is developed in a developing operation that is conducted in a condition where the developer layer contacts the photosensitive drum 2. The developing sleeve 4*a* is driven to rotate at a predetermined rotary speed in the direction indicated by the corresponding arrow which is opposite to the direction of the rotary movement (as indicated by arrow R) of the photosensitive drum 2 in the developing section c (see FIG. 2).

In this embodiment, negatively charged toner having an average particle diameter of 6 $\mu$m and magnetic carrier having an average particle diameter of 35 $\mu$m with saturated magnetization of 205 emu/cm$^3$ are used. The developer is prepared by mixing toner and carrier at a weight ratio of 6:94.

As shown in FIG. 2, the developer containing section 4*h*, in which the developer circulates, is divided into two zones by a longitudinal partition wall 4*d* except the opposite ends. Agitating screws 4*e*A, 4*e*B are arranged at the opposite lateral sides of the partition wall 4*d*.

As shown in FIG. 4, toner is supplied from toner supply containers 5 (which will be described hereinafter) arranged above the developing device 4 and allowed to drop to the remote side (right side in FIG. 4) of the agitating screw 4*e*B. Then, the supplied toner is agitated as it is moved to the longitudinal front side (as indicated by arrow K1 in FIG. 4) so as to pass through the front end (left side in FIG. 4) where the partition wall 4*d* is not found. Then, the toner is further driven to the longitudinal remote side (as indicated by arrow K2 in FIG. 4) by the agitating screw 4*e*A so as to pass through the remote end where the partition wall 4*d* is not found either to continue the circulation.

Now, the developing step of visualizing the electrostatic latent image formed on the photosensitive drum 2 by means of the developing device 4, using the dual-component magnetic brush method, and the developer circulation system of the embodiment will be described below.

As the developing sleeve 4*a* is driven to rotate in the direction indicated by the corresponding arrow in FIG. 2, the developer contained in the developing container is pumped up to the surface of the developing sleeve 4*a* at the pumping pole of the magnet roller 4*b* and then conveyed. A thin layer of the developer is formed on the developing sleeve 4*a* to a thickness that is regulated by the regulating blade 4*c* arranged perpendicularly relative to the developing sleeve 4*a*. As the layer of the developer is conveyed to the developing pole thereof that corresponds to the developing section c, standing bristles are formed by the magnetic force. Thus, the electrostatic latent image on the surface of the photosensitive drum 2 is developed into a toner image by the toner contained in the developer and urged to form bristles. In this embodiment, the electrostatic latent image is subjected to reversal development.

The developer that has passed through the developing section c and got to the surface of the developing sleeve 4*a* immediately moves into the inside of the developing container due to the rotation motion of the developing sleeve 4*a* and comes to be separated from the surface of the developing sleeve 4*a* by the repulsive magnetic field of the conveyance pole so that it is returned to the developer reservoir in the developer container. A DC voltage and an AC voltage are applied to the developing sleeve 4*a* from a developing bias applying power source (not shown). In this embodiment, a DC voltage of −500 V and an AC voltage with a frequency of 2,200 Hz and an inter-peak voltage of 1,500 V are applied to selectively develop the exposed areas (light portion) of the photosensitive drum 2.

Generally, when an AC voltage is applied in the dual-component development, a fogged image is apt to be produced although the developing effect is boosted to produce a high quality image. In view of this fact, a potential difference is normally provided between the DC voltage applied to the developing sleeve 4*a* and the surface potential of the photosensitive drum 2 in order to prevent fog from appearing. More specifically, a developing bias voltage that is between the electric potential of the exposed areas and that of the unexposed areas of the photosensitive drum 2 is applied to prevent fog from appearing.

As toner is consumed by developing operations, the toner density in the developer falls. In this embodiment, a sensor 4*g* (see FIG. 2) for detecting the toner density is arranged at a position close to the outer peripheral surface of the agitating screw 4*e*B. When the sensor 4*g* detects that the toner density in the developer falls below a predetermined density level, an instruction for supplying toner into the developing device 4 from the corresponding toner supply container 5 is issued. Thus, the toner density in the developer is constantly maintained to a predetermined level by the toner supply operation.

Toner Supply Containers

Figure 3:
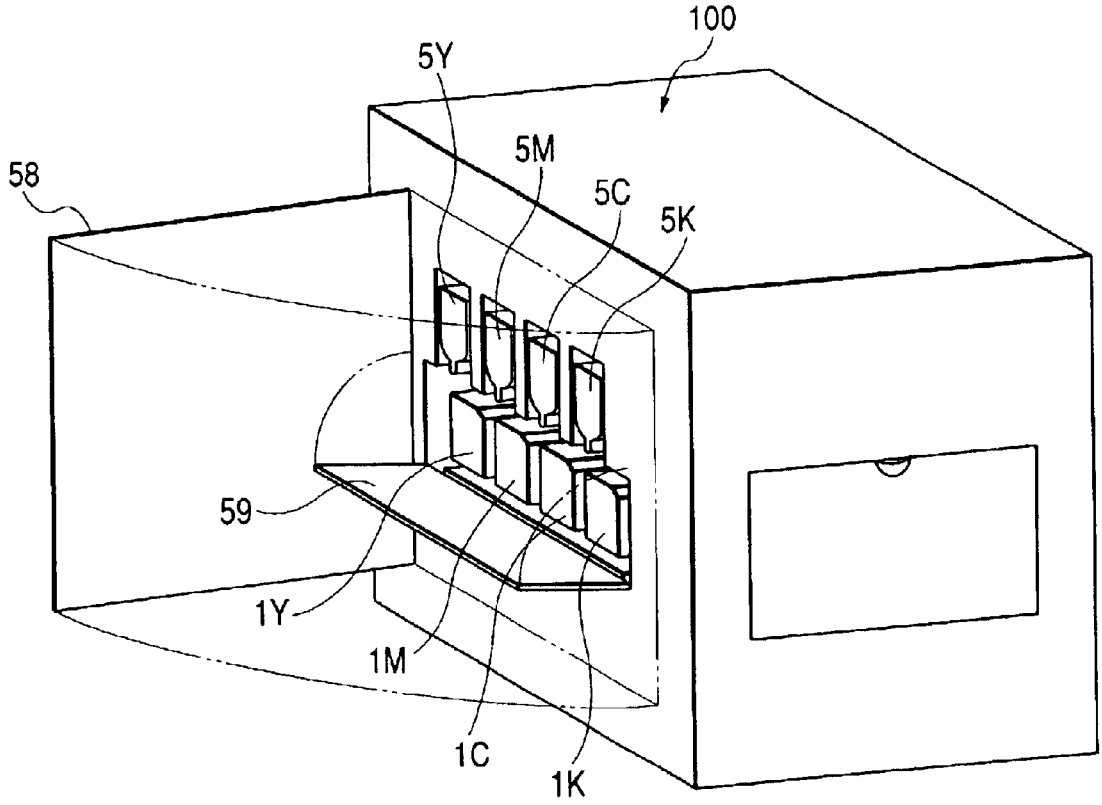
FIG. 3 is a schematic perspective view of the main body of the apparatus of FIG. 1 with the front door and the centering plate removed from the front side thereof to expose the toner supply containers and the process cartridges.

As shown in FIG. 1, the toner supply containers 5Y, 5M, 5C, 5K are arranged above the respective process cartridges 1Y, 1M, 1C, 1K. Each of them can be fitted to and removed from the proper position through the front side of the image forming apparatus main body 100, while the front door 58 is open as shown in FIG. 3.

Figure 5:
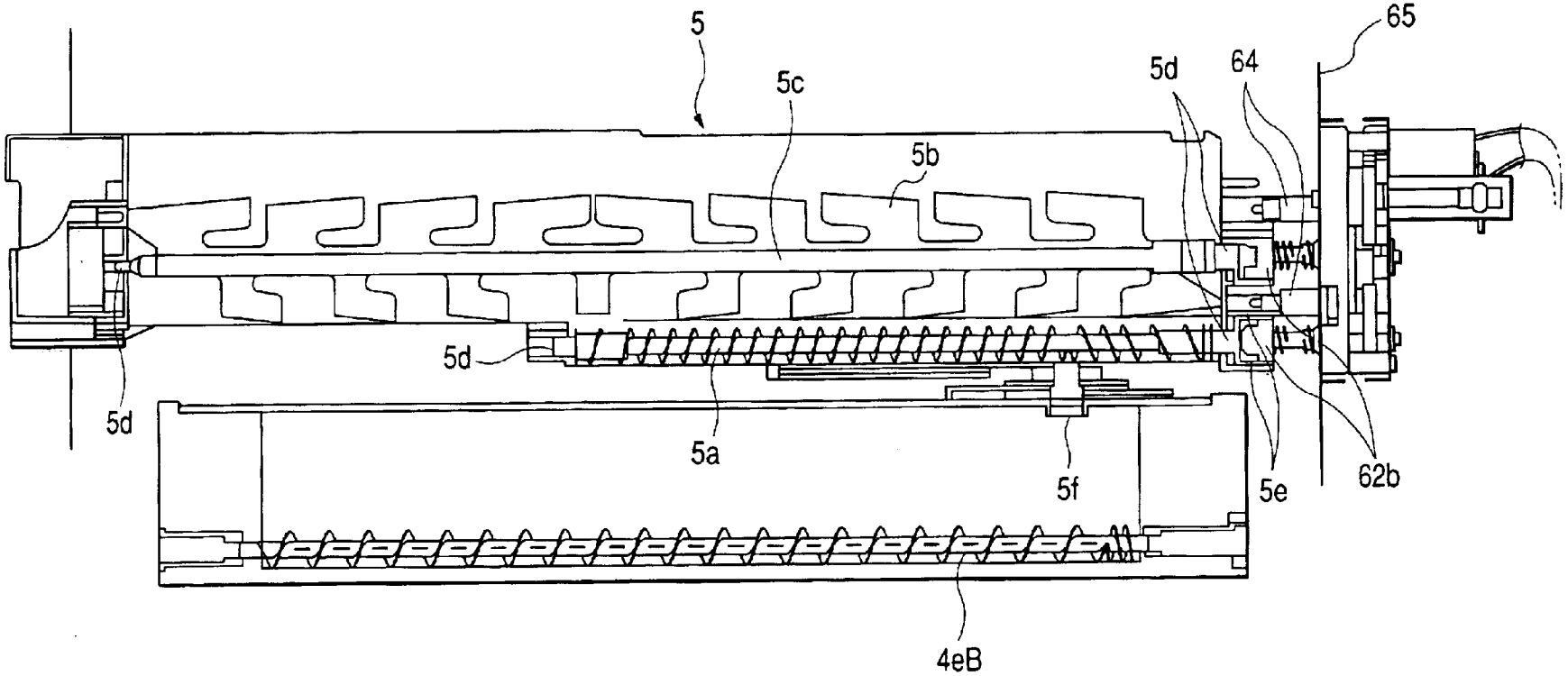
FIG. 5 is a schematic longitudinal cross sectional view of the apparatus of FIG. 1 taken along a line running through the agitating shaft and the screw shaft of one of the toner supply containers.

As shown in FIG. 2, an agitating plate 5*b* and a screw 5*a* are rigidly secured to the agitating shaft 5*c* in each of the toner supply containers 5 and a discharging aperture 5*f* for discharging toner is provided at the bottom of the container. As shown in FIG. 5 (a longitudinal cross sectional view taken along the agitating shaft 5*c* and the shaft of the screw 5*a*), both the screw 5*a* and the agitating shaft 5*c* are rotatably supported at the opposite ends thereof by bearings 5*d* and provided at the remote ends (right ends in FIG. 5) with respective (recessed) drive couplings 5*e*. Drive force is transmitted from the corresponding (projecting) drive couplings 62*b* of the image forming apparatus main body 100 to the (recessed) drive couplings 5*e* to drive the screw 5*a* and the agitating shaft 5*c* to rotate. The screw 5*a* has a pair of helical ribs arranged around its shaft, the ribs being arranged at the opposite sides of the discharging aperture 5*f* and twisted in opposite directions. The screw 5*a* is driven to rotate in a predetermined direction as the corresponding (projecting) drive coupling 62*b* rotates. Then, toner is conveyed toward the discharging aperture 5*f* and forced to fall freely from the discharging aperture 5*f* so as to supply toner to the corresponding process cartridge 1. The radial front end of the agitating plate 5*b* is inclined so that it abuts and scrapes the wall surface 5*g* of the toner supply container 5 with a given angle. More specifically, the front end of the agitating plate 5*b* is twisted to become helical. As the front end of the agitating plate 5*b* is twisted and tilted, axial conveying force is generated to forward toner in the longitudinal direction of the toner supply container 5. It should be noted here that the toner supply container 5 of this embodiment is not limited to dual-component development and may be used to supply toner to a process cartridge or a developing cartridge adapted to mono-component development. Additionally, powder that can be contained in the toner supply container 5 is not limited to toner and the toner supply container 5 may be used to contain a so-called developer of a mixture of toner and magnetic carrier.

Intermediate Transferring Unit (Transfer Means)

The intermediate transferring unit 54 that operates as secondary transfer means is adapted to collectively transfer the multi-color toner image formed by sequentially transferring mono-color images from the photosensitive drums 2 of the different colors for primary transfer onto the transfer material 52.

As shown in FIG. 1, the intermediate transferring unit 54 is provided with an intermediate transferring belt (separate member) 54*a* that operates as image receiving member and is adapted to run in the direction as indicated by arrow R1 (clockwise). The intermediate transferring belt 54*a* runs at almost same speed (about 17 mm/sec) as the process speed of the photosensitive drum 2. The intermediate transferring belt 54*a* is an endless belt with a length of about 940 mm and wound around three rollers including a drive roller 54*b*, one of a pair of oppositely disposed secondary transfer rollers, or roller 54*g*, and a follower roller 54*c*. Additionally, a total of four transfer charging rollers 54*f* operating as transfer chargers are rotatably arranged in the inside of the intermediate transferring belt 54*a* at respective positions opposite to the corresponding photosensitive drums 2 under pressure directed toward the centers of the respective photosensitive drums 2. The transfer charging rollers 54*f* are fed with electricity from a high transfer bias voltage applying power source (not shown) so as to electrically charge the rear surface of the intermediate transferring belt 54*a* to the polarity opposite to that of toner and sequentially transfer the toner images on the photosensitive drums onto the front surface of the intermediate transferring belt 54*a* for primary transfer. As a result, the toner images of the four colors of yellow, magenta, cyan and black are laid one on the other by the intermediate transferring belt 54*a*.

In the secondary transfer section, a secondary transferring roller 54*d* operating as transfer member is pressed against the intermediate transferring belt 54*a* at a position opposite to the other secondary transfer roller, or roller 54*g*. The secondary transfer roller 54*d* is adapted to rotate and move (swing) vertically in FIG. 1. Note that the intermediate transferring belt 54*a* and the secondary transferring roller 54*d* are driven to run separately. As the secondary transfer roller 54*d* is moved upward and the transfer material 52 is driven to move into the secondary transfer section in a condition where it is held in contact with the intermediate transferring belt 54*a*, a predetermined secondary transfer bias voltage is applied to the secondary transfer roller 54*d* from a secondary transfer bias voltage applying power source (not shown). As a result, the toner images of the four colors on the intermediate transferring belt 54*a* are collectively transferred onto the transfer material 52 for secondary transfer. At this time, the transfer material 52 that is pinched between the intermediate transferring belt 54*a* and the secondary transferring roller 54*d* is conveyed leftward in FIG. 1 at a predetermined rate during the transferring step and then further to the fixing device 56 for the next fixing step.

A cleaning unit 55 is arranged at a predetermined position (near the follower roller 54*c*) of the running course of the intermediate transferring belt 54*a*, which is located most downstream in the zone of the transferring step. The cleaning unit 55 is removably held in contact with the surface of the intermediate transferring belt 54*a* so as to remove the residual toner left on the intermediate transferring belt 54*a* after the secondary transferring operation. A cleaning blade 55*a* is arranged in the cleaning unit 55 to remove the residual toner. The cleaning unit 55 is arranged in such a way that it can swing from the center of rotation (not shown) and the cleaning blade 55*a* is pressed against the intermediate transferring belt 54*a* so as to bite the latter to a certain extent. The residual toner that is taken into the cleaning unit 55 is then conveyed to a waste toner tank (not shown) by means of a feed screw (not shown) and stored there.

The intermediate transferring belt 54*a* may be made of polyimide resin, although the material of the intermediate transferring belt 54*a* is not limited to polyimide resin and may alternatively be selected from other materials including plastic materials such as polycarbonate resin, polyethyleneterephthalate resin, polyvinylidenefluoride resin, polyethylenenaphthalate resin, polyetherketone resin, polyethersulfone resin and polyurethane resin and fluorine type and silicon type rubber materials. Fixing device (fixing means) The toner image formed on the photosensitive drum 2 by the developing device 4 is transferred onto the transfer material 52 by way of the intermediate transferring belt 54*a*. Then, the fixing device 56 fixes by heat the toner image transferred onto the transfer material 52.

As shown in FIG. 1, the fixing device 56 comprises a fixing roller 56*a* for applying heat to the transfer material 52 and a pressure roller 56*b* for applying pressure onto the transfer material 52 and bringing it into firm contact with the fixing roller 56*a* under pressure. The rollers 56*a* and 56*b* are hollow rollers and provided in the inside with respective heaters (not shown). As the rollers are driven to rotate, they convey the transfer material 52 simultaneously. More specifically, the transfer material 52 that is carrying a toner image and being conveyed is pinched between the fixing roller 56*a* and the pressure roller 56*b* and heat and pressure are applied to it so that consequently the toner image on the surface thereof is fixed. After the fixing step, the transfer material 52 is discharged onto the sheet discharging tray 57*d* arranged on the top of the image forming apparatus main body 100 by means of the discharging rollers 57*a*, 57*b*, 57*c* of the discharging means 57. The sheet discharging tray 57*d* can store a number of sheets, or transfer materials 52.

Mounting of Process Cartridges and Toner Supply Containers

Now, the sequence of mounting the process cartridges 1 and the toner supply containers 5 will be described by referring to FIGS. 2, 3, 4 and 5.

As shown in FIG. 3, a front door 58 is arranged at the front of the image forming apparatus main body 100. By definition, it can be opened and closed. As the front door is pulled outwardly and opened, the opening through which the process cartridges 1 (1Y, 1M, 1C, 1K) and the toner supply containers 5 (5Y, 5M, 5C, 5K) are mounted and removed is exposed.

A centering plate 59 is fitted in the opening for mounting the process cartridges 1. The centering plate 59 is a like a swing door and can be opened and closed around the lower end thereof. The process cartridges 1 are mounted and removed after opening the centering plate 59.

As shown in FIG. 2, the image forming apparatus main body 100 is provided in the inside with pairs of guide rails 60 for guiding operations of mounting/removing the respective process cartridges 1 and pairs of guide rails 61 for guiding operations of mounting/removing the respective toner supply containers 5. The process cartridges 1 and the toner supply containers 5 are mounted and removed in a direction parallel to the axial direction of the photosensitive drum 2 and hence the guide rails 60, 61 are arranged in the same direction. The process cartridges 1 and the toner supply containers 5 are put into the image forming apparatus main body 100 as they are made to slide on the respective pairs of guide rails 60, 61 from the near end side to the remote end side of the main body 100. Then, as each process cartridge 1 is pushed to the bottom in a manner as shown in FIG. 4, the corresponding centering shaft 66 of the image forming apparatus main body 100 is inserted into the center hole 2*f* of the corresponding drum flange 2*b* to align the center of rotation of the remote side of the corresponding photosensitive drum 2 relative to the image forming apparatus main body 100. At the same time, the drive transmitting section 2*g* formed in the drum flange 2*b* and the (projecting) drive coupling 62*a* are linked to each other so that the photosensitive drum 2 can be driven to rotate. The drive transmitting section 2*g* used in this embodiment shows a profile of a twisted triangular column. As drive force is applied thereto from the image forming apparatus main body 100, the drive force is transmitted to the photosensitive drum 2 and, at the same time, force for pulling the photosensitive drum 2 to the remote side is generated. Support pins 63 are projecting from the rear side plate 65 of the image forming apparatus main body 100 for the purpose of aligning the respective process cartridges 1 so that, as each of the support pins 63 is inserted into the frame of the corresponding process cartridges 1, the process cartridge 1 is firmly held in position.

The above described swing door type centering plate 59 is arranged at the near side (front side) of the image forming apparatus main body 100 and the near side bearing cases 2*c* of the process cartridges 1 are securely held by the centering plate 59 when the latter is closed. As a result of the above described series of inserting operations, the photosensitive drums 2 and the process cartridges 1 are aligned relative to the image forming apparatus main body 100.

On the other hand, as shown in FIG. 5, as each of the toner supply containers 5 is inserted to the bottom, it is aligned with and securely held by the corresponding one of the support pins 64 projecting from the rear side wall 65 of the image forming apparatus main body 100. At the same time, the (recessed) drive coupling 5*e* of the toner supply container 5 and the corresponding (projecting) drive coupling 62*a* are linked to each other so that the screw 5*a* and the agitating shaft 5*c* (agitating plate 5*b*) can be driven to rotate.

Configuration of Developer Charging Devices (Brush Units)

Figure 6:
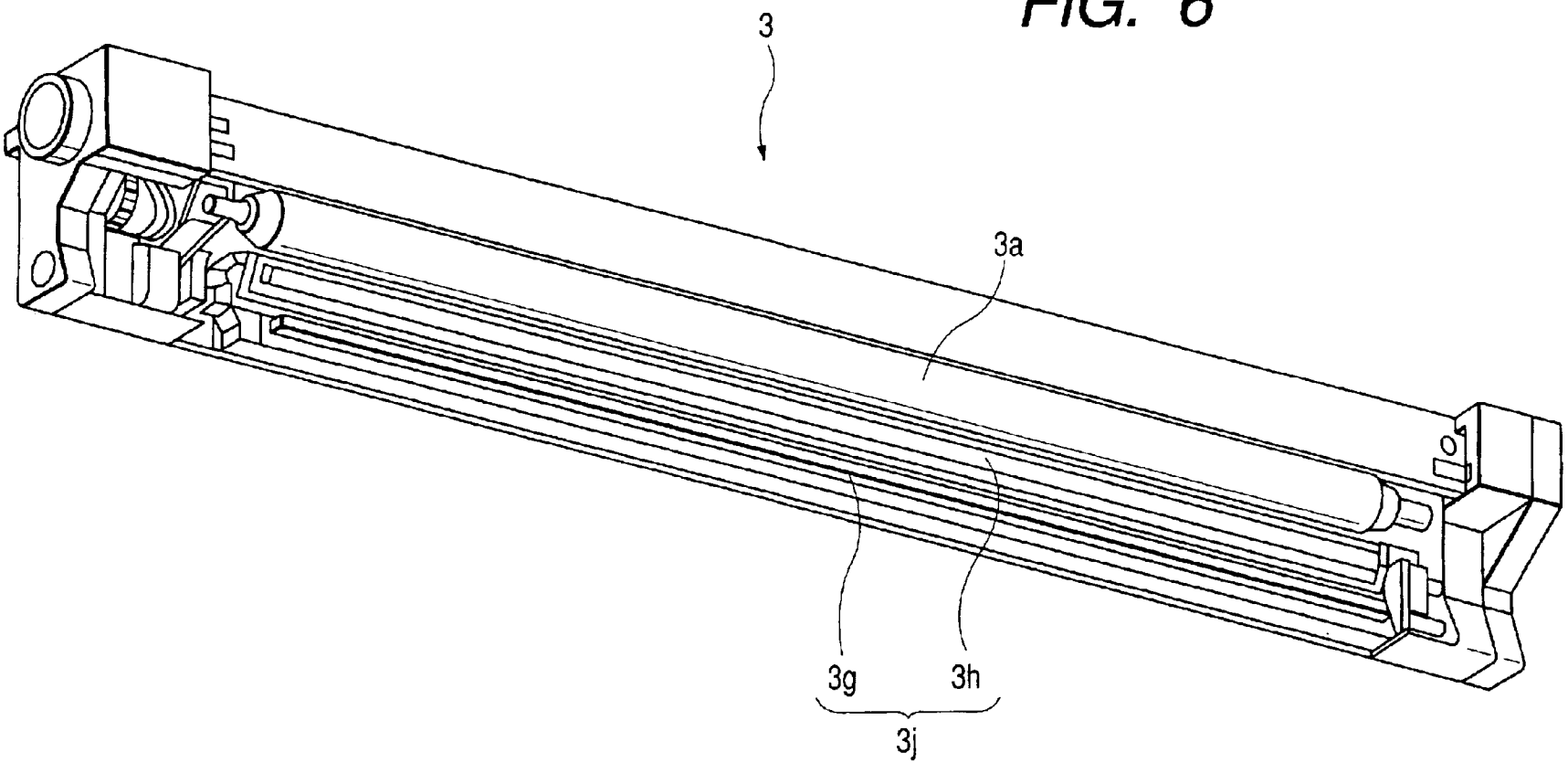
FIG. 6 is a schematic perspective view of the one of the primary chargers and the corresponding brush unit of the apparatus of FIG. 1.
Figure 7:
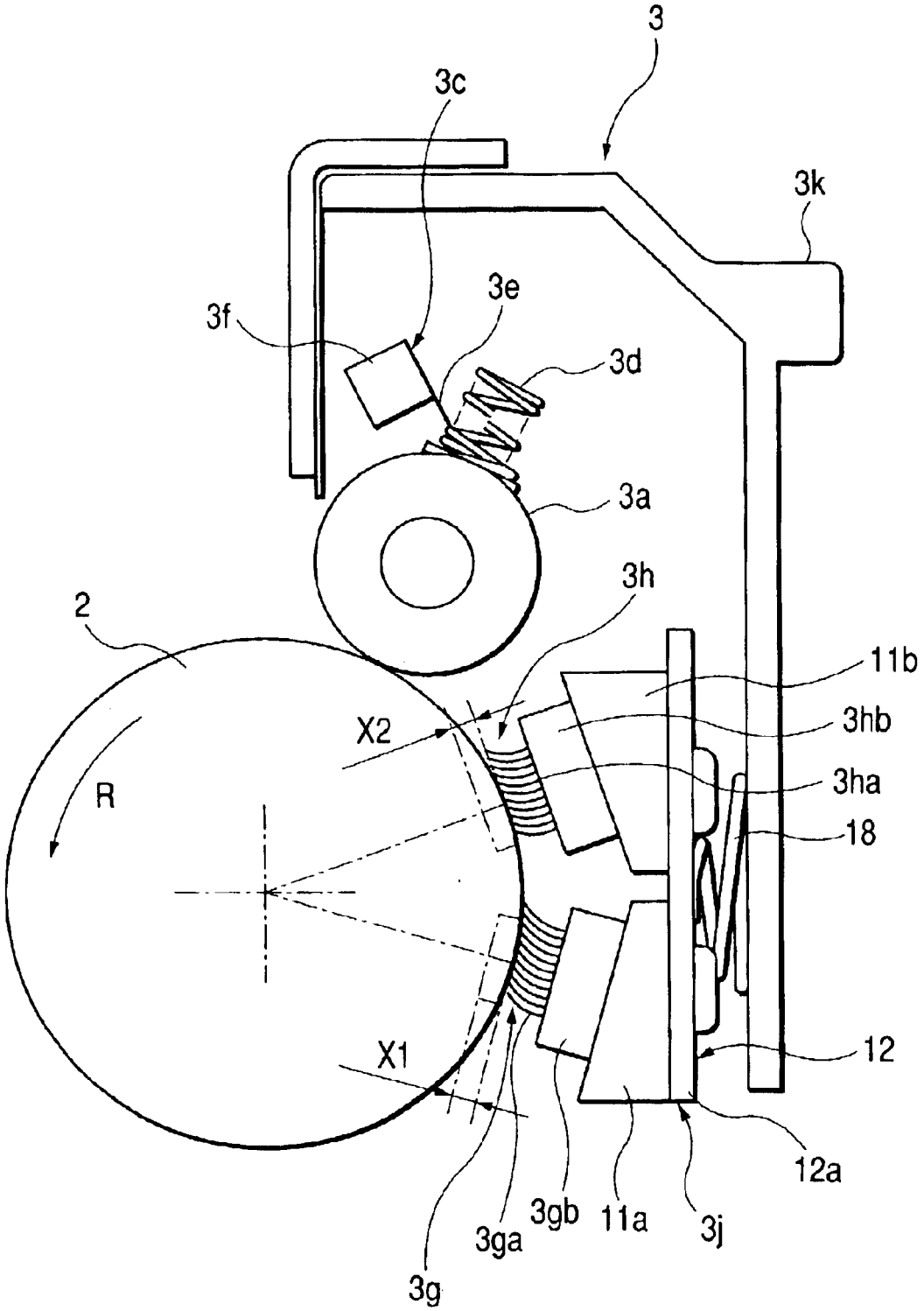
FIG. 7 is a schematic longitudinal cross sectional view of the primary charger and the brush unit of FIG. 6 taken along a line intersecting the longitudinal direction of the corresponding charging roller.
Figure 8:
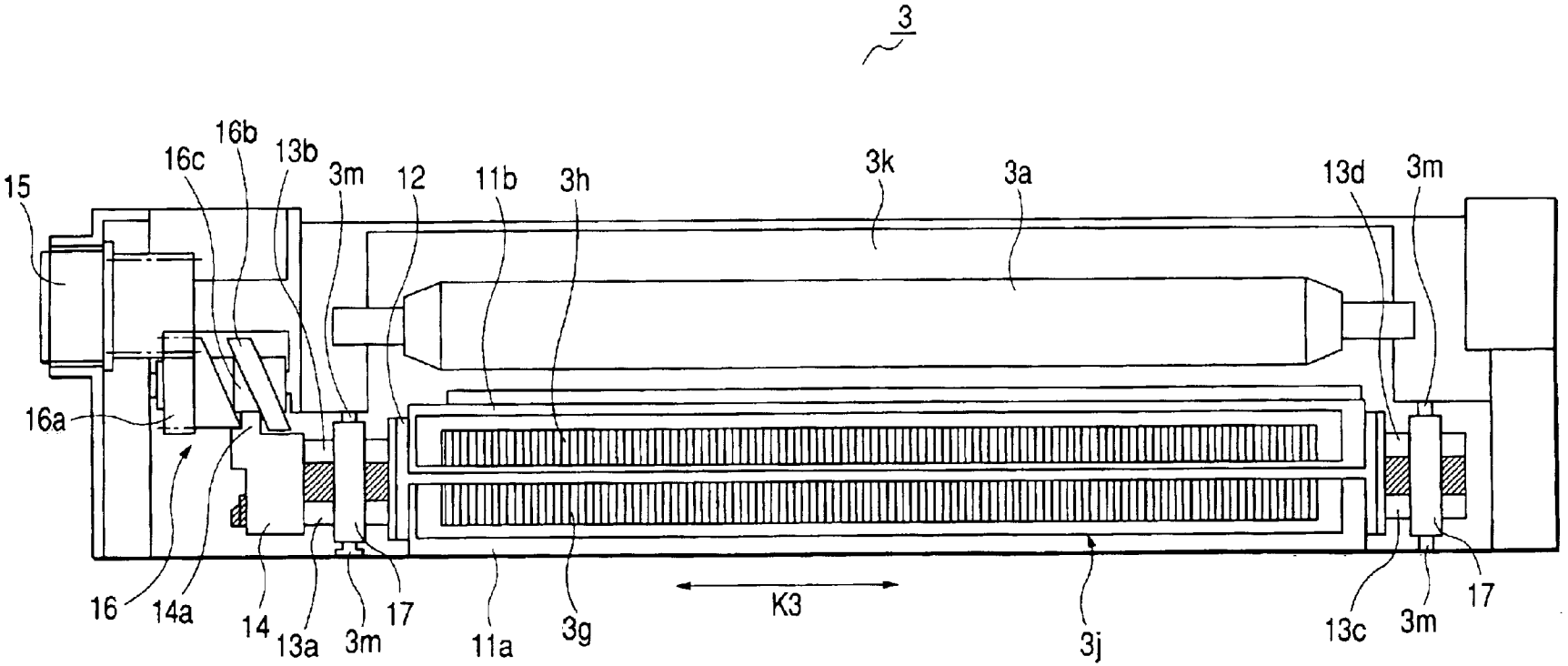
FIG. 8 is a schematic front view of the primary charger and the brush unit of FIG. 6.
Figure 9:
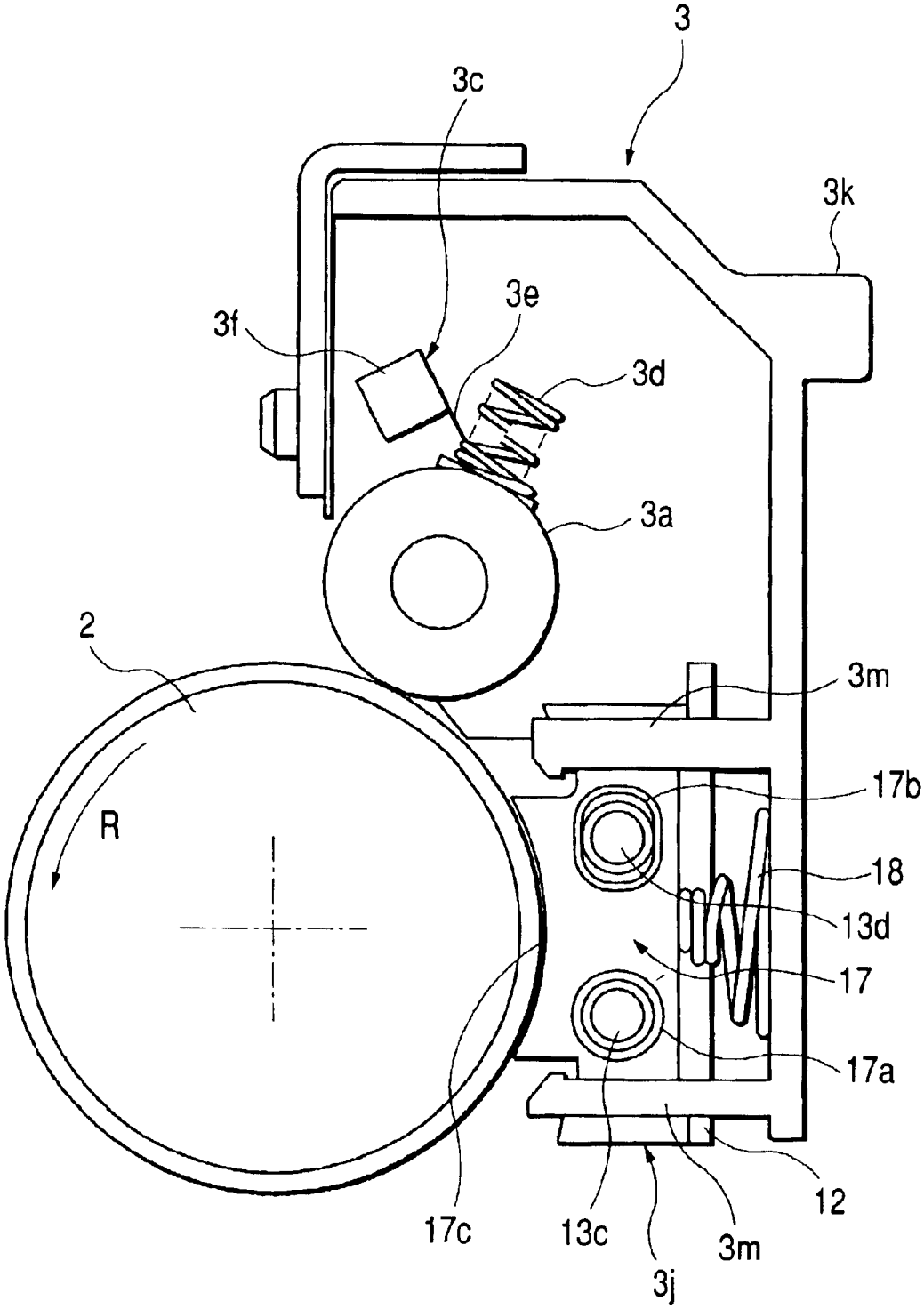
FIG. 9 is a schematic lateral view of the primary charger and the brush unit of FIG. 6.
Figure 10:
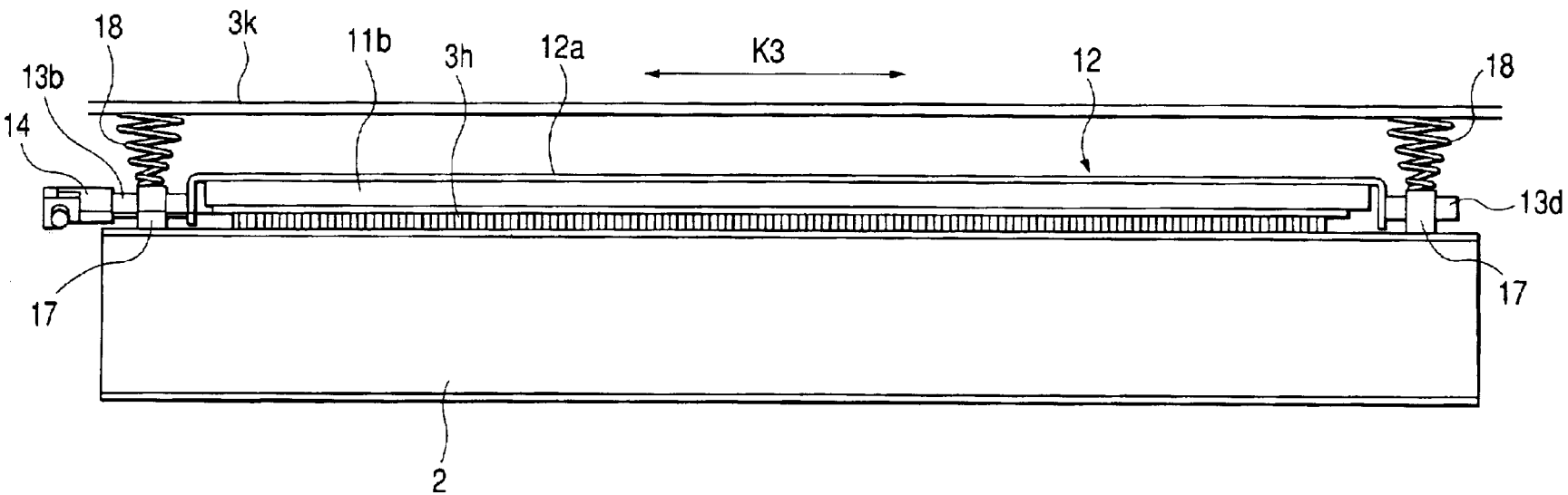
FIG. 10 is a schematic plan view of the primary charger and the brush unit of FIG. 6.

Now, the toner processing devices of this embodiment that operate as developer charging devices will be described in detail by referring to FIGS. 6 through 10. In this embodiment, each toner processing device comprises a brush unit 3*j*. The brush unit 3*j* is fitted to the frame 3*k* of the corresponding primary charger 3, although it may be needless to say that the brush unit 3*j* may be provided as a unit separate from the primary charger 3. The FIGS. 6 through 10 illustrate one of the brush units (toner processing device) 3*j* and the corresponding primary charger 3 of the embodiment. More specifically, FIG. 6 is a perspective view and FIG. 7 is a longitudinal cross sectional view of the primary charger 3 and the brush unit 3*j* taken along a direction intersecting the longitudinal direction of the corresponding charging roller 3*a*, whereas FIGS. 8, 9 and 10 are respectively a front view, a lateral view and a plan view of the primary charger 3 and the brush unit 3*j*.

As shown in FIGS. 7 and 8, the residual toner equalizing means 3*g* and the toner charge control means 3*h* described above are unitized into a brush unit 3*j*. In the brush unit 3*j*, the residual toner equalizing means 3*g* is rigidly supported by the brush base 11*a*, which brush base 11*a* is by turn rigidly secured to the base frame 12*a* made of sheet metal typically by means of thermal caulking, screws or fastener tapes (dual-side adhesive tapes). Similarly, the toner charge control means 3*h* is rigidly supported by the brush base 11*b*, which brush base 11*b* is by turn rigidly secured to the support member 12. As shown in FIG. 8, shafts 13*a*, 13*b*, 13*c*, 13*d* are extending outwardly from the longitudinal opposite ends of the support member 12 and a transmission arm member 14 is fitted to the shafts 13*a*, 13*b* at the drive side (left side in FIG. 8). The above described brush bases 11*a*, 11*b* are arranged with certain respective angles in such a way that their surfaces where the residual toner equalizing means 3*g* and the toner charge control means 3*h* are respectively fitted are substantially directed toward the center of the photosensitive drum 2. As pointed out above, the brush unit 3*j* is formed by fitting the residual toner equalizing means 3*g* and the toner charge control means 3*h* to the support member 12 so as to unitize them in such a way that the front ends of the brushes of the residual toner equalizing means 3*g* and the toner charge control means 3*h* contact the surface of the photosensitive drum 2.

Configuration of Brush Units

Each of the primary chargers (charging means) 3 of the embodiment is provided at the drive side, or the remote side-(left side in FIG. 8), of the longitudinal direction thereof with a coupling gear 15 and a reciprocating cam 16 as drive transmission means in such a way that the coupling gear 15 and the reciprocating cam 16 are rotatably supported by the frame 3*k* of the primary charger 3. The reciprocating cam 16 has a cam gear 16*a* that is in mesh with the coupling gear 15 and a cam section 16*b*, which cam section 16*b* is provided with an inclined cam groove 16*c*. The cam groove 16*c* is held in engagement with the projecting section 14*a* of the transmission arm member 14 of the brush unit 3*j*. As the primary charger 3 is mounted into the image forming apparatus main body 100, the main body coupler (not shown) of the image forming apparatus main body 100 comes into engagement with the coupling gear 15 and the rotary drive force of the image forming apparatus main body 100 is transmitted to the reciprocating cam 16 by way of the main body coupler and the coupling gear 15 as the coupling gear 15 is in mesh with it. As a result, the reciprocating cam 16 is driven to rotate.

As the reciprocating cam 16 rotates, the projecting section 14*a* of the transmission arm member 14 of the brush unit 3*j* that is engaged with the cam groove 16*c* is moved along the cam groove 16*c* in the longitudinal direction of the primary charger 3 so that consequently the entire brush unit 3*j* reciprocates in the direction of the transmission arm member 14 (in the direction of arrow K3 in FIGS. 8 and 10). The brush unit 3*j* of this embodiment is adapted to reciprocate in a constant cycle period between 0.5 and 2.5 seconds with a stroke of 5 mm.

Support of Brush Unit and Extents of Bite of Brushes

As shown in FIG. 7, of the above described brush unit 3*j*, the residual toner equalizing means (developer dispersing member) 3*g* and the toner charge control means (developer charging member) 3*h*, which are realized in the form of so many brushes, are directed toward the center of photosensitive drum 2 and supported in such a way that the front ends of the brushes bite the surface of the photosensitive drum 2 respectively to predetermined extents X1, X2. If the extents X1, X2 of bite are not satisfied, the residual toner can easily pass through the residual toner equalizing means 3*g* and the toner charge control means 3*h* so that the residual toner is not charged sufficiently and an uneven charge can appear on the residual toner. If, on the other hand, the extents X1, X2 of bite are too large, the residual toner equalizing means 3*g* and the toner charge control means 3*h* can push the photosensitive drum 2 under excessive pressure to excessively block the residual toner and scrape it off from the surface of the photosensitive drum 2.

If the residual toner equalizing means 3*g* and the toner charge control means 3*h* are not properly directed to the center of the photosensitive drum 2, their brushes may not bite the surface of the photosensitive drum 2 to the proper extents and can press the surface of the photosensitive drum 2 in a direction opposite to the direction of the rotary movement of the photosensitive drum 2 so that they abut the photosensitive drum in that direction in operation to counter the rotary movement of the photosensitive drum and consequently scrape off the residual toner from the surface of the photosensitive drum 2.

Therefore, as shown in FIGS. 8 and 9, each of the brush units 3*j* is provided at the longitudinal opposite ends thereof with respective spacers 17 that operate as attitude maintaining means so that the residual toner equalizing means 3*g* and the toner charge control means 3*h* are held in such a way that they are correctly directed towards the center of the photosensitive drum 2 and the front ends of the brushes bite the surface of the photosensitive drum 2 always to the respective proper extents X1, X2.

As shown in FIG. 9, the spacers 17 are members made of synthetic resin realized in an arc form and the abutting surfaces 17*c* of the spacers 17 that come into contact with the surface of the photosensitive drum 2 are so profiled as to exactly match the surface. More specifically, the spacers 17 are preferably made of a synthetic resin material that shows an excellent sliding property such as polyacetal resin (POM), polyphenylenesulfide (PPS) or polyamide resin (Nylon, tradename). Each of the spacers 17 is provided with a lower side centering hole 17*a* and an upper side oblong hole 17*b*. As shown in FIGS. 8 and 9, the shafts 13*c*, 13*d* are respectively axially movably inserted into the centering hole 17*a* and the oblong hole 17*b* of the near side spacer 17, whereas the shafts 13*a*, 13*b* are respectively axially removably inserted into the centering hole 17*a* and the oblong hole 17*b* of the remote side spacer 17. As a result, the brush unit 3*j* is longitudinally movable (in the direction indicated by arrow K3 in FIGS. 8 and 10) but positionally restricted in the rotary direction of the photosensitive drum 2.

Additionally, the brush unit 3*j* is biased by compression springs 18, which are urging member, so that consequently the abutting surfaces (arc sections) 17*c* of the spacers 17 arranged at the opposite ends of the brush unit 3*j* are urged by the respective compression springs 18 to abut the surface of the photosensitive drum 2 under predetermined pressure. The abutting surfaces 17*c* of the spacers 17 show a contour corresponding to the surface profile of the photosensitive drum 2. As shown in FIG. 10, the compression springs 18 are fitted to the respective spacers 17 arranged at the opposite ends of the brush unit 3*j* so as to directly urge the spacers 17. The spacers 17 are positionally restricted in the longitudinal direction of the brush unit 3*j* by respective guide sections 3*m* (see FIG. 9) arranged at predetermined respective positions on the frame 3*k* of the primary charger 3 and abut movable along the guide sections 3*m* along the surface of the photosensitive drum 2. The compression springs 18 are arranged between the frame 3*k* of the primary charger 3 and the respective spacers 17. Since the spacers 17 do not reciprocate in the longitudinal direction of the photosensitive drum 2, the brush unit 3*j* is stably biased toward the photosensitive drum 2 by the spacers 17 that are directly urged by the compression springs 18 regardless of any reciprocating motion.

As a result, the brush unit 3*j* is separated from the surface of the photosensitive drum 2 by a predetermined distance by means of the spacers 17 and adapted to maintain a predetermined attitude relative to the photosensitive drum 2. More specifically, the front end of the brush of the residual toner equalizing means 3*g* and that of the brush of the toner charge control means 3*h* are adapted to maintain a predetermined attitude relative to the photosensitive drum 2 so that they can reliably bite the surface of the photosensitive drum 2 to the respective extents X1, X2. The extents X1, X2 of bite of the front ends of the respective brushes are preferably between 0.5 and 2.5 mm. X1, X2=1.5 mm is adopted for this embodiment. The compression springs 18 preferably provide spring pressure between 0.5 and 2 kgf. A value of 1 kgf is adopted for the spring pressure of this embodiment.

As driven by the image forming apparatus main body 100, the shafts 13*a* through 13*d* extending from the opposite ends of the brush unit 3*j* are respectively thrust to slide in the centering holes 17*a* and the oblong holes 17*b* of the spacers in a state where the spacers 17 keep on applying predetermined pressure to the surface of the photosensitive drum 2 and hence the brush unit 3*j* is held to maintain its attitude relative to the photosensitive drum 2. As a result, the brush unit 3*j* can reciprocate in the longitudinal direction, while maintaining the extents X1, X2 of bit of the front ends of the brushes.

Thus, with the above described embodiment, fusion and adhesion of toner to the surface of the photosensitive drum 2 due to an excessive charge of the residual toner in small (local) areas and adhesion of toner to the surface of the photosensitive drum 2 due to an insufficient charge of the residual toner can be effectively suppressed or prevented as the toner charge control means 3*h* is moved in the longitudinal direction (in the direction of arrow K3 in FIGS. 8 and 10). Additionally, since the residual toner is collected effectively by the developing device 4, neither defective charges nor defective images occur. Still additionally, the image forming apparatus can be down-sized due to the use of a cleanerless system.

<Embodiment 2>

Figure 11:
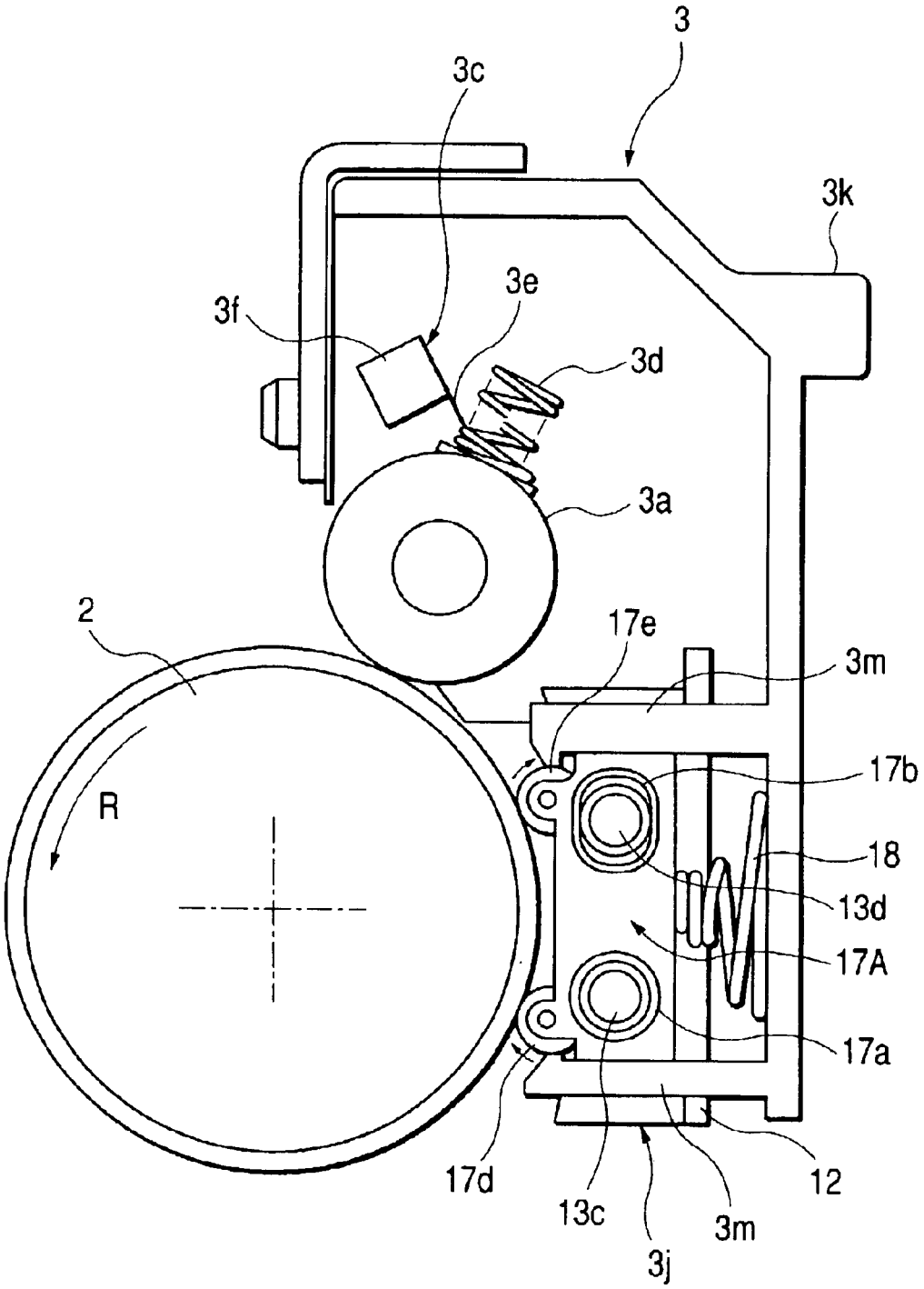
FIG. 11 is a schematic lateral view of one of the primary chargers and the brush unit thereof of the second embodiment of the invention.

FIG. 11 is a schematic lateral view of one of the brush units 3*j* of the second embodiment according to the invention. This embodiment differs from the above described first embodiment in terms of the configuration of the spacers 17A. Since the remaining components of this embodiment are same and identical with those of the first embodiment, they will not be described any further.

While the abutting surfaces 17*c* of the spacers 17 of the first embodiment are forced to abut the surface of the photosensitive drum 2, rotatable disks (roller members) 17*d*, 17*e* are employed for each of the spacers 17A and adapted to abut the surface of the photosensitive drum in this embodiment.

Each of the spacers 17A is provided at the side thereof that faces the surface of the photosensitive drum 2 with rotatable disks 17*d*, 17*e*. The disks 17*d*, 17*e* are urged by a compression spring 18 so as to abut the surface of the photosensitive drum 2. While FIG. 11 shows only the near side spacer 17A, the remote side spacer 17A (not shown) has a same configuration. In this way, each of the spacers 17A is provided with two disks 17*d*, 17*e* that abut the surface of the photosensitive drum 2 so that consequently the brush unit 3*j* is separated from the surface of the photosensitive drum 2 by a predetermined distance and adapted to maintain a predetermined attitude relative to the photosensitive drum 2.

In addition to the advantages described above by referring to the first embodiment, this embodiment provides an advantage that the disks 17*d*, 17*e* are made to rotate to follow the rotary motion of the photosensitive drum 2 so that the surface of the photosensitive drum 2 is not scraped by the disks 17*d*, 17*e* at the positions where they abut the surface and hence the brush unit 3*j* remains to be separated from the surface of the photosensitive drum 2 by a predetermined distance for a long time. In other words, the extents X1, X2 of bites of the brushes of the residual toner equalizing means 3*g* and the toner charge control means 3*h* can be held unchanged during the service life of the product.

While each of the spacers 17A of this embodiment is provided with two disks 17*d*, 17*e* in order to control the attitude of the brush unit 3*j*, three or more than three disks may alternatively be used for each spacer to achieve a similar effect.

While the image carrier is described in terms of a photosensitive drum for the above embodiments, the present invention is equally applicable to an image carrier realized in the form of a photosensitive belt without missing any of the above described advantages of the invention.

While a residual toner equalizing means 3*g* and a toner charge control means 3*h* are unitized into a brush unit 3*j* in each of the above described embodiments, the present invention is by no means limited thereto. For example, only either a residual toner equalizing means 3*g* or a toner charge control means 3*h* may be used for a brush unit to achieve a substantially similar effect.

Furthermore, while a brush units 3*j* is fitted to the frame 3*k* of a primary charger 3 so as to constitute part of a process cartridge 1 in each of the above described embodiments, the brush unit 3*j* may alternatively be arranged outside the process cartridge. In other words, the brush unit 3*j* may be arranged not at the side of the process cartridge but at the side of the image forming apparatus main body.

A developer charging member is arranged at a position separated from an image carrier by a predetermined distance and driven to reciprocate in the generating line direction of the surface of the image carrier while it is forced to abut the surface of the image carrier in each of the above described embodiments so that the untransferred residual toner may be charged effectively and uniformly to prevent defective charges (defective primary charges) and defective images from appearing.

On the other hand, when the image forming operation of an image forming apparatus is suddenly suspended due to a sheet accidentally caught in the apparatus and resumed after removing the sheet, there can occur a situation where the toner image on the photosensitive drum is not transferred and a large volume of residual toner (untransferred toner) moves onto the brush members. Then, in such an unordinary situation, the large volume of toner may not be able to pass through the brush members so that it may eventually fall into the image forming apparatus main body.

In view of such a situation, the following embodiments of developer charging device according to the invention are provided at a lower part of the device with a flexible member for catching the residual developer falling from the spot and its vicinity of the device where it operates on the photosensitive body in order to prevent the residual toner remaining on the surface of the photosensitive body from accumulating on part of the reciprocating developer charging member and eventually falling to contaminate the image forming apparatus.

<Embodiment 3>

Now, the third embodiment of charging means according to the invention will be described below.

Figure 12:
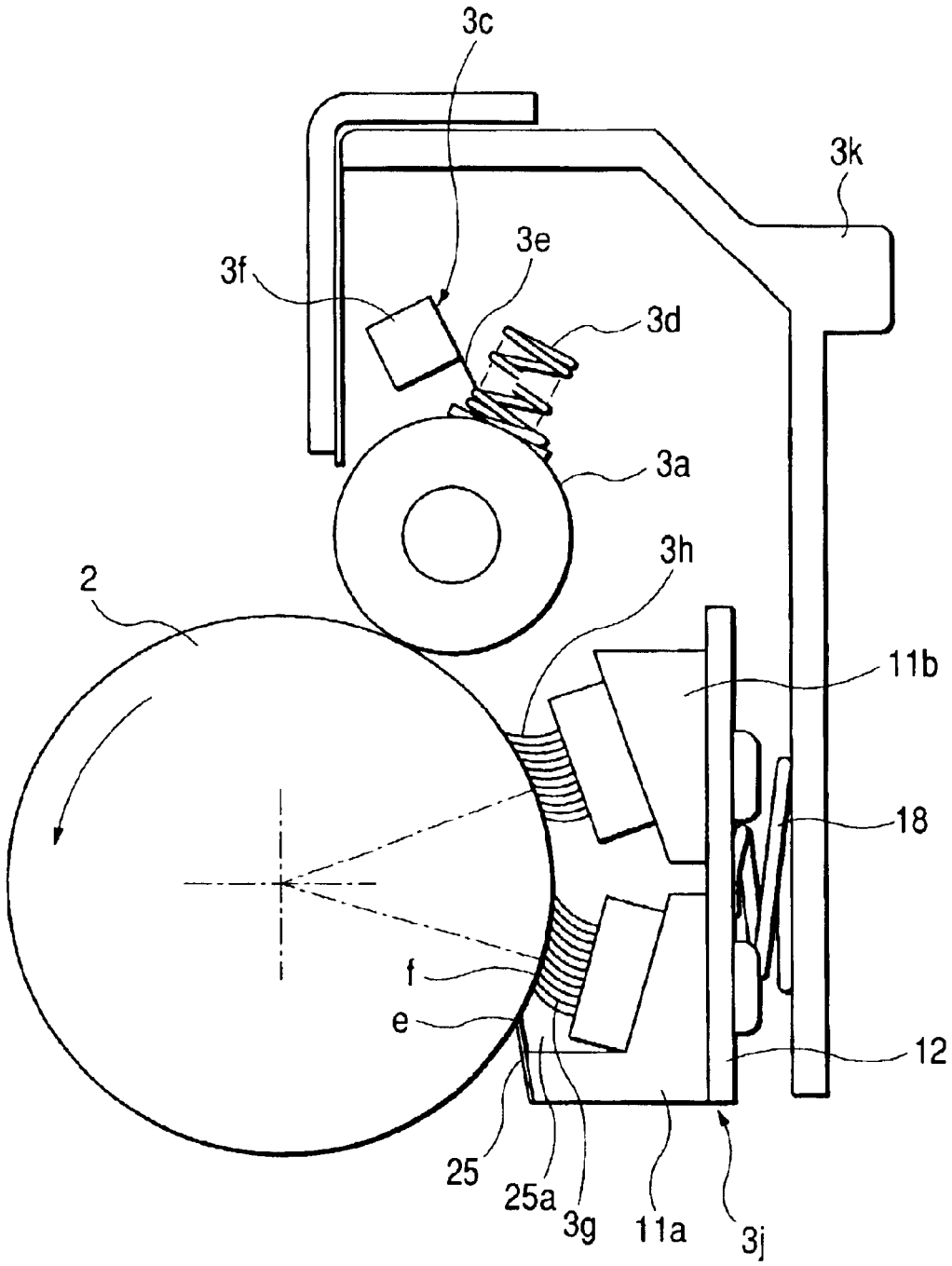
FIG. 12 is a schematic longitudinal cross sectional view of the third embodiment of charging means according to the invention.
Figure 13:
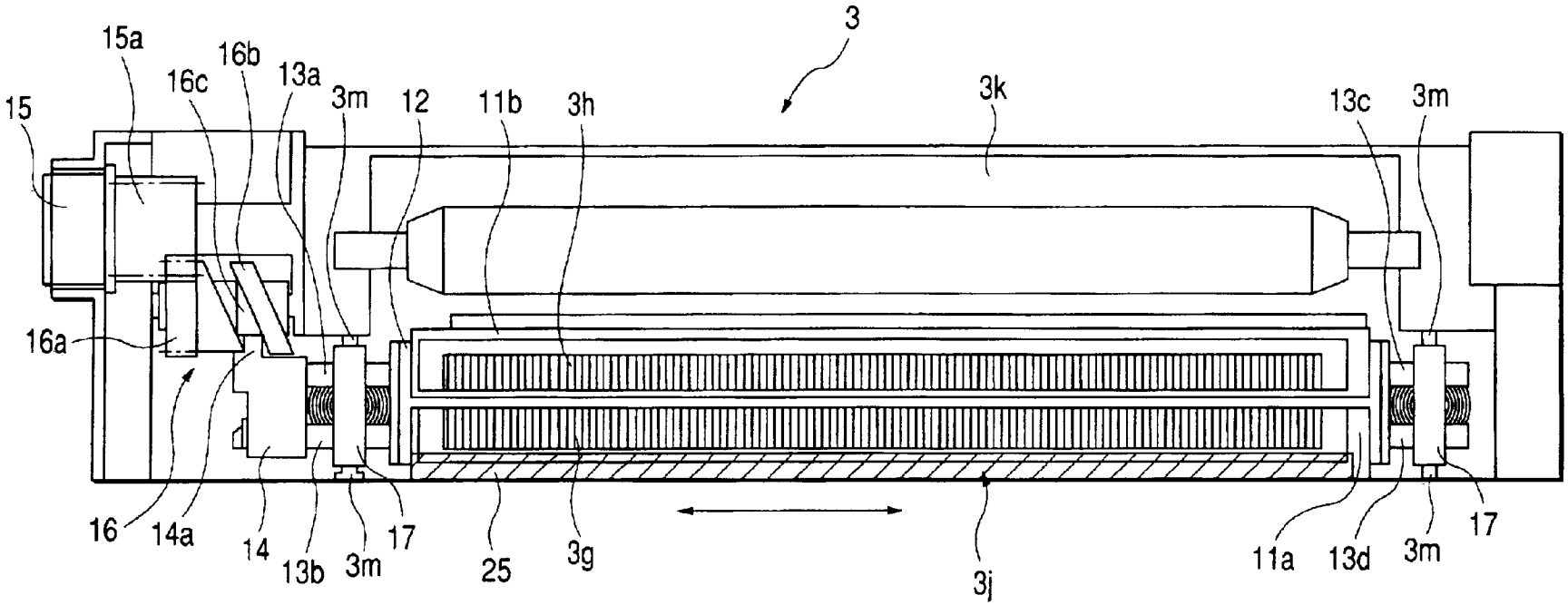
FIG. 13 is a schematic front view of the third embodiment of charging means according to the invention.
Figure 14:
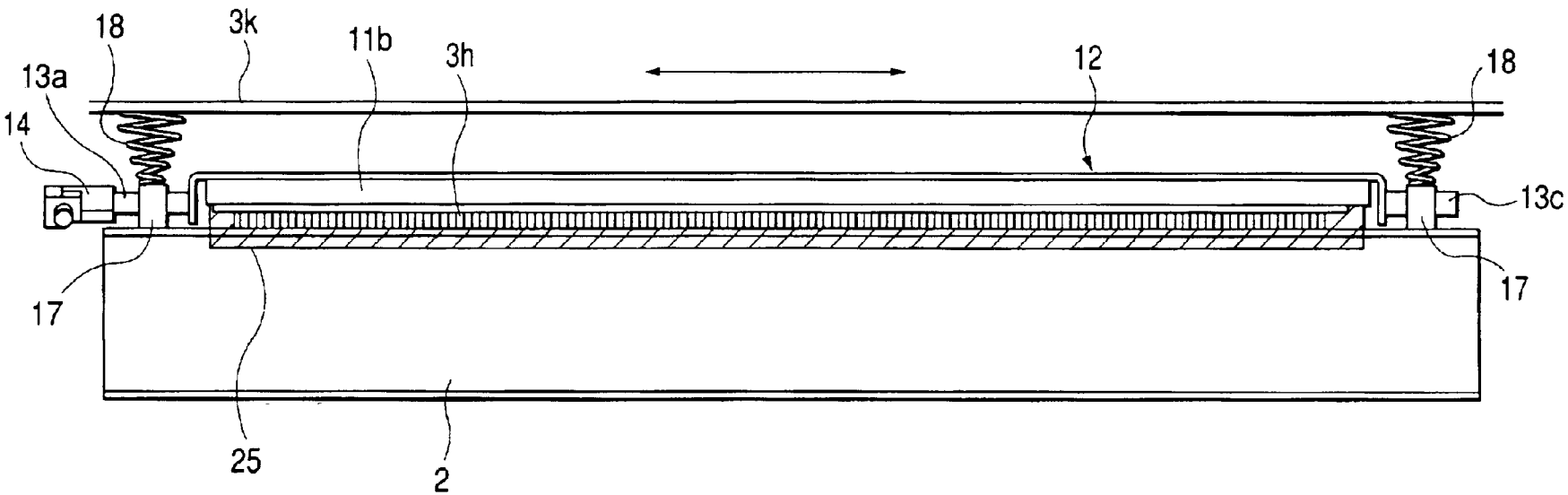
FIG. 14 is a schematic plan view of one of the brush units of the third embodiment of charging means according to the invention.

FIG. 12 is a schematic longitudinal cross sectional view of the third embodiment of charging means according to the invention and FIG. 13 is a schematic front view of the third embodiment of the invention, while FIG. 14 is a schematic plan view of one of the brush units of the third embodiment of the invention.

Configuration of Brush Unit of Charging Means

As shown in FIG. 12, in the brush unit 3*j* produced by unitizing a residual toner equalizing means 3*g* and a toner charge control means 3*h* as process means, the residual toner equalizing means 3*g* is rigidly held by a brush base 11*a*, which brush base 11*a* is by turn rigidly secured to a base frame 12 made of sheet metal typically by means of thermal caulking, screws or fastener tapes (dual-side adhesive tapes). Similarly, the toner charge control means 3*h* is rigidly supported by a brush base 11*b*, which brush base 11*b* is by turn rigidly secured to the base frame 12. As shown in FIG. 13, shafts 13*a*, 13*b*, 13*c*, 13*d* are extending outwardly from the longitudinal opposite ends of the base frame 12 and a transmission arm member 14 is fitted to the shafts 13*a*, 13*b* at a side (the drive side). As shown in FIG. 12, the residual toner equalizing means 3*g* and the toner charge control means 3*h* are arranged with certain respective angles in such a way that they are directed toward the center of the photosensitive drum 2. As pointed out above, the brush unit 3*j* is formed by fitting the residual toner equalizing means 3*g* and the toner charge control means 3*h* to the base frame 12 so as to unitize them in such a way that the front ends of the brushes of the residual toner equalizing means 3*g* and the toner charge control means 3*h* contact the surface of the photosensitive drum 2. The brushes of the residual toner equalizing means 3*g* and the toner charge control means 3*h* are held to abut the surface of the photosensitive drum 2 in such a way that they bite the surface of the photosensitive drum 2 and inclined so as to follow the rotary movement of the peripheral surface of the photosensitive drum 2 when the photosensitive drum 2 is driven to rotate counterclockwise as shown in FIG. 12.

A toner catching sheet 25, which is a flexible member, is arranged below the brush unit 3*j*. The toner catching sheet 25 is bonded at an end thereof to the brush base 11*a* of the brush unit 3*j* and at the other end, which is a free end, adapted to abut the photosensitive drum 2 so as to catch a large volume of residual toner (untransferred toner) that may be held to the photosensitive drum 2 and eventually fall down as it is unable to pass through the residual toner equalizing means 3*g* and the toner charge control means 3*h*. Therefore, the toner catching sheet 25 can prevent toner from leaking out from the developer charging device to the outside. The front end of the toner catching sheet 25 is oriented to the moving direction of the peripheral surface of the photosensitive drum 2.

As shown in FIG. 12, the position e of the front end of the toner catching sheet 25 is separated from the position f on the residual toner equalizing means 3*g* where the peripheral surface of the photosensitive drum 2 that rotates counter-clockwise firstly touches the brush 3*g*. If an orthogonal coordinate system having an origin located at the center of the photosensitive drum 2 is assumed in FIG. 2, the positions e and f are located in the lower right quadrant in FIG. 12 and the position e is shifted from the position f in the horizontal direction (x-direction). Therefore, the untransferred residual toner that is falling from the photosensitive drum 2 at the position f is reliably taken into the catching space 25*a* defined by the toner catching sheet 25. The catching space 25*a* may be referred to as a sort of container.

As may be seen from the above description, a gap may be provided between the front end of the toner catching sheet 25 and the photosensitive drum 2 if the positions e, f are separated from each other by a sufficient horizontal distance. Note, however, that the bristles of the residual toner equalizing means 3*g* and the toner charge control means 3*h* are standing upright in the brush unit 3*j* when the latter is not mounted on the device and left alone. In other words, it is difficult to tell at the time of assembling the device to which side the bristles will fall. The risk that the bristles of the residual toner equalizing means 3*g* are directed against the direction of the rotary movement of the peripheral surface of the photosensitive drum 2 at the time of assembling the device is avoided when the positions e, f are made to come close to or agree with each other.

The toner catching sheet 25 is required so as not to damage the photosensitive drum 2 if it is forced to abut and slide on the photosensitive drum 2. Therefore, it is realized in the form of a flexible sheet member typically made of polyethyleneterephthalate (PET) or urethane and having a thickness between 0.025 and 0.3 mm so that it may lightly abut the photosensitive drum 2.

The width of the toner catching sheet 25 as viewed in the longitudinal direction of the embodiment is such that it exceeds the stretch in which untransferred residual toner can fall and hence is wider than the residual toner equalizing means 3*g* and the toner charge control means 3*h*. Thus, the toner catching sheet 25 can reliably catch any falling residual toner over the entire width thereof.

Configuration of Brush Unit Drive Mechanism

As shown in FIG. 13, the charging means 3 is provided at a longitudinal end thereof with a coupling gear 15 and a reciprocating cam 16 as drive transmission means, which coupling gear 15 and reciprocating cam 16 are supported by and rotatably held in mesh with the frame 3*k* of the charging means 3. The reciprocating cam 16 comprises a cam gear 16*a* that is engaged with the gear section 15*a* of the coupling gear 15 and a cam 16*b*, which cam gear 16*a* and cam 16*b* define a cam groove 16*c* and are linked to each other so that they rotate together. The cam groove 16*c* receives and is held in mesh with the projecting section 14*a* of the transmission arm member 14 of the brush unit 3*j*. Thus, as the process cartridges 1Y, 1M, 1C and 1K are mounted in the image forming apparatus main body 100, each of the couplings (not shown) of the apparatus main body 100 comes into engagement with the coupling gear 15 of the corresponding one of the process cartridges so that rotary drive force is transmitted from the apparatus main body to the coupling gear 15 so as to drive the reciprocating cam 16 that is held in engagement with the coupling gear 15 to rotate.

As the reciprocating cam 16 rotates, the projecting section 14*a* of the transmission arm member 14 of the brush unit 3*j* that is held in mesh with the cam groove 16*c* is driven to slide in the cam groove 16*c* and moved in the longitudinal direction of the device so that the shafts 13*a*, 13*b*, 13*c*, 13*d* rigidly secured to the transmission arm member 14 reciprocate along with the brush unit 3*j*. At this time, the shafts 13*a*, 13*b*, 13*c*, 13*d* slide with the spacers 17, which are attitude maintaining means, as they are supported by the spacers 17. The spacers 17 are engaged with the respective guide rails 3*m* arranged on the frame 3*k* and guided by the latter so that they may move toward and back from the center of the photosensitive drum 2 but cannot move in the longitudinal direction of the drum. Compression coil springs 18 are arranged in a compressed state between the respective spacers 17 and the frame 3*k* so that the brush unit 3*j* is urged to abut the photosensitive drum 2 under pressure due to the spring force of the coil springs 18. In this embodiment, the brush unit 3*j* is adapted to reciprocate in a constant cycle period between 0.5 and 2.5 seconds with a stroke of 5 mm.

When a large volume of untransferred residual toner is produced on the photosensitive drum as described above and forced to drop from the drum 2 by the residual toner equalizing means 3*g* and the toner charge control means 3*h* that reciprocate, the toner catching sheet 25 integrally reciprocates with them. In other words, the toner catching sheet 25 is always found below the stretch where residual toner can fall as follower. Therefore, any residual toner is prevented from falling into the image forming apparatus main body.

<Embodiment 4>

Figure 15:
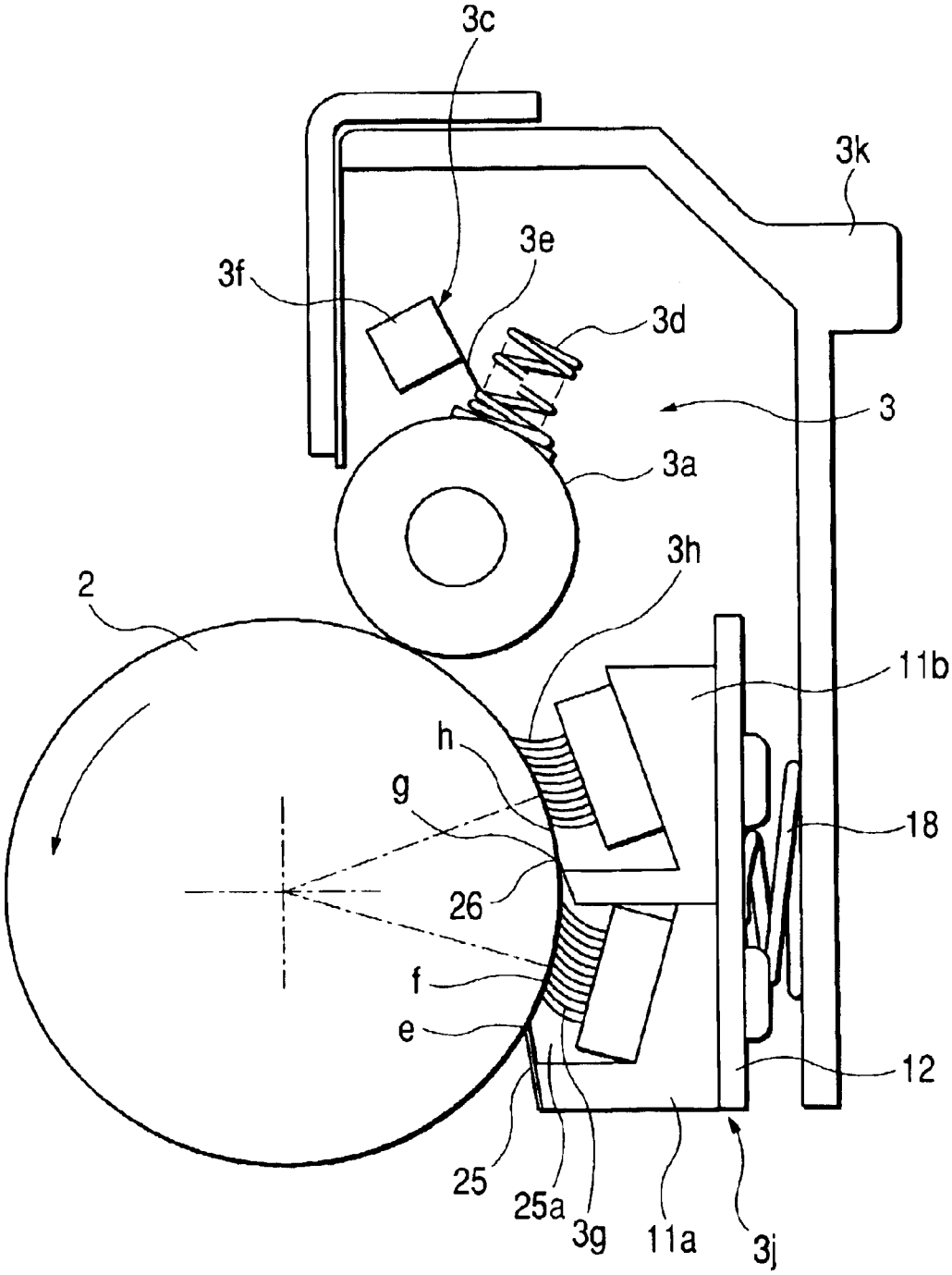
FIG. 15 is a schematic longitudinal cross sectional view of the fourth embodiment of charging means according to the invention.

FIG. 15 schematically illustrates the fourth embodiment of charging means according to the invention. As described above, third embodiment is provided with a toner catching sheet 25 that is arranged upstream relative to the charging means 3 having a charging roller 3*a* as viewed in the moving direction of the peripheral surface of the photosensitive drum 2 and downstream relative to the part of the photosensitive drum 2 located vis-à-vis the intermediate transferring unit 54 and adapted to catch the residual toner falling from an area of the photosensitive drum 2 located immediately upstream relative to the position of the residual toner equalizing means 3*g* for equalizing the residual toner image remaining on the photosensitive drum after the transferring step as viewed in the moving direction of the peripheral surface of the photosensitive drum 2.

Now, this embodiment is additionally provided with another residual toner catching sheet 26, which is also a flexible member, that is arranged upstream relative to the charging means 3 and immediately upstream relative to the toner charge control means 3*h* for charging the residual toner remaining on the photosensitive drum 2 after the transferring step to the predetermined polarity as viewed in the moving direction of the peripheral surface of the photosensitive drum 2 and downstream relative to the transferring means and immediately downstream relative to the transferring means for transferring the toner image formed on the photosensitive drum 2 onto the transfer material as viewed in the moving direction of the peripheral surface of the photosensitive drum 2. The sheet 26 is rigidly fitted at the base thereof to the brush base 11*b* and held in contact with the photosensitive drum 2 at the front end thereof. As viewed in the moving direction of the peripheral surface of the photosensitive drum 2, the position h through which the peripheral surface of the photosensitive drum 2 comes to the toner charge control means 3*h* is separated from the position g of the front end of the residual toner catching sheet 26 that is held in contact with the photosensitive drum 2. Therefore, the residual toner that leaves the photosensitive drum 2 to fall at or near the position h is led to the base side of the toner catching sheet 26.

The description on the longitudinal position of the toner catching sheet 25 that is given earlier also applies to the longitudinal position of the toner catching sheet 26. In short, the toner catching sheet 26 is arranged at a position where it can catch all the residual toner falling from the photosensitive drum 2. The risk that the bristles of the toner charge control means 3*h* are directed against the direction of the rotary movement of the peripheral surface of the photosensitive drum 2 can be avoided when the positions g, h are selected appropriately.

Thus, a cleanerless type process cartridge that is adapted to move in the longitudinal direction integrally with a developer charging device provided with one or more than one flexible members (toner catching sheets) arranged below the developer charging device in order to catch the residual developer left on the photosensitive body and falling from the latter and an image forming apparatus comprising such process cartridges provide the following advantages.

(1) Since the one or more than one flexible members (toner catching sheets) move integrally with the developer charging device for scraping off residual developer, they can reliably catch the falling developer and prevent any toner from falling into the image forming apparatus main body.

(2) Since the one or more than one flexible members (toner catching sheets) move integrally with the developer charging device, the widths of the toner catching sheets as viewed in the longitudinal direction of the device can be minimized (to make them equal to the width of the developer charging device) to reduce the cost of the toner catching sheets.

(3) Since the one or more than one toner catching sheets are made of PET or urethane and have a thickness between 0.025 and 0.3 mm, they do not damage the surface of the photosensitive body if they are driven to reciprocate while they are held in abutment with the photosensitive body.

The residual toner equalizing means 3*g* and the toner charge control means 3*h* are realized in the form of so many brush-shaped members that are electrically conductive to an appropriate degree. Therefore, the front ends of their brush sections may fall in the moving direction of the photosensitive drum as the latter is driven to rotate. If the front ends are made fall in a direction opposite to the direction of the rotary movement of the photosensitive drum at the time of assembling so that they abut the photosensitive drum in that direction in operation to counter the rotary movement of the photosensitive drum, the residual toner on the photosensitive drum can be scraped off by the brush-shaped members. Additionally, if the standing bristles of the brush sections fall from their bases, the density of the bristles contacting the photosensitive drum and the pressure under which the bristles push the photosensitive drum can be reduced in the related areas. Then, it will no longer possible to sufficiently charge the residual toner with electricity to give rise to a problem that toner adhere to and smear the contact charge member.

Particularly, as a result of diversified users' needs in recent years, a large volume of residual toner can be produced at a time particularly when photographic images that show a high printing ratio are continuously printed or when color images are printed by using a multiple printing process on the photosensitive drum so that consequently the above problems can become even more remarkable.

In view of such circumstances, the following embodiments are so designed that a situation where the brush members abut the photosensitive body in a direction opposite to the direction of the rotary movement of the photosensitive body and scrape off the residual developer left on the photosensitive body is effectively prevented and the abutment (abutting pressure and density) of the brush members relative to the photosensitive body is stably maintained in terms of the direction of the rotary movement of the electrophotographic photosensitive body.

More specifically, in the following embodiments, either a falling bristles holding member for preventing bristles of a brush member from falling from the bases thereof due to the rotary movement of the photosensitive body or a tilting member for tilting the bristles of a brush member toward the direction of the rotary movement of the photosensitive body is provided. The tilting member is arranged at a position upstream relative to the brush member as viewed in the moving direction of the photosensitive body.

<Embodiment 5>

Figure 16:
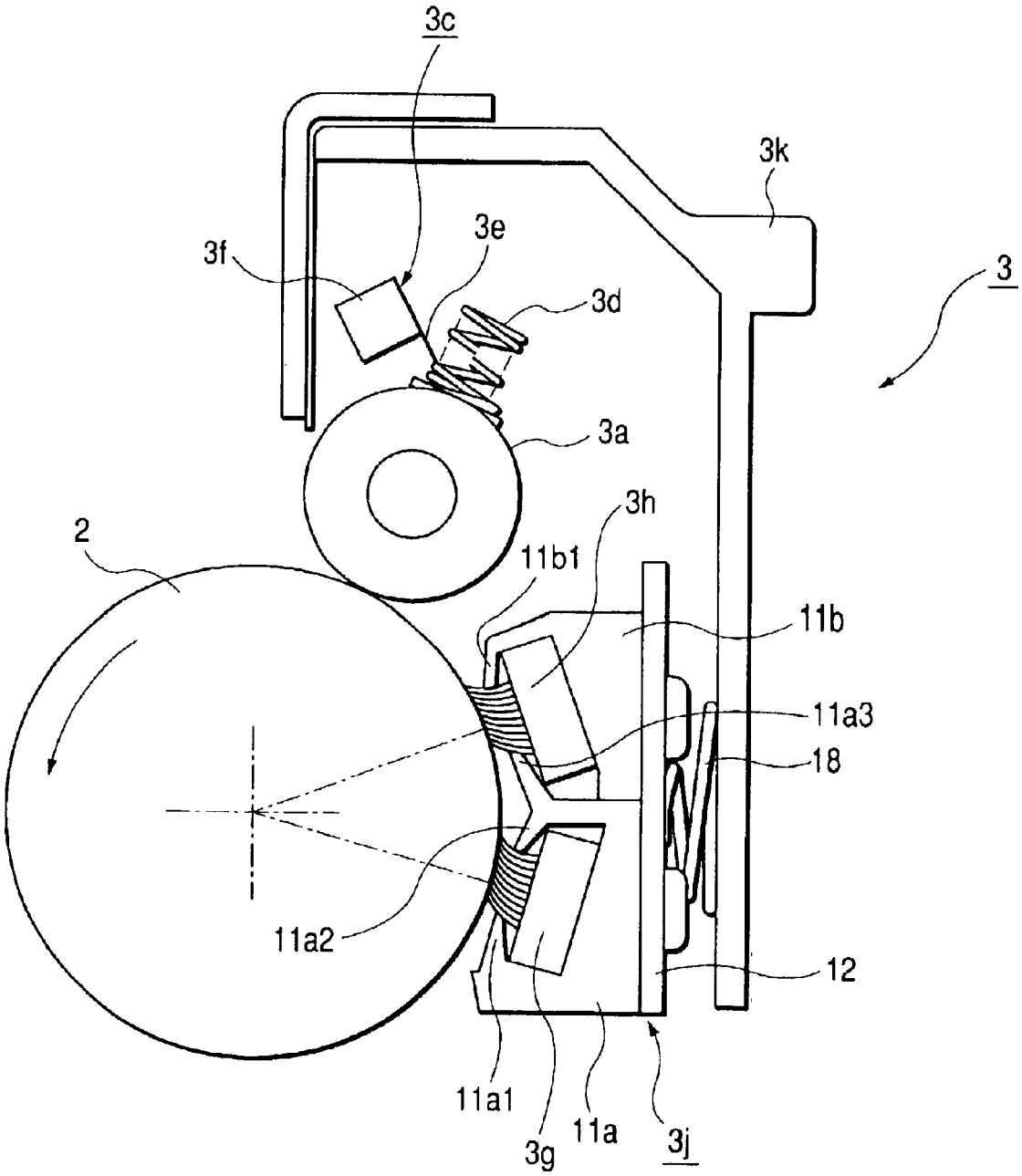
FIG. 16 is a schematic cross sectional view of the fifth embodiment of charging means according to the invention.
Figure 17:
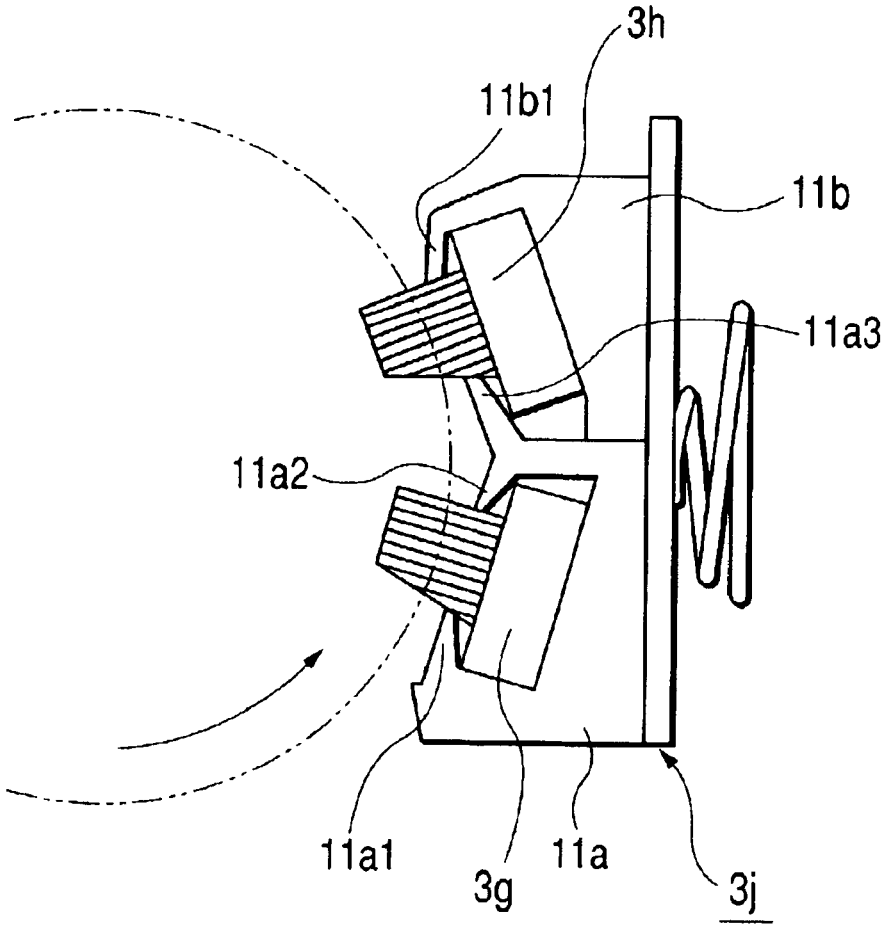
FIG. 17 is a schematic front view of the fifth embodiment of charging means according to the invention.
Figure 18:
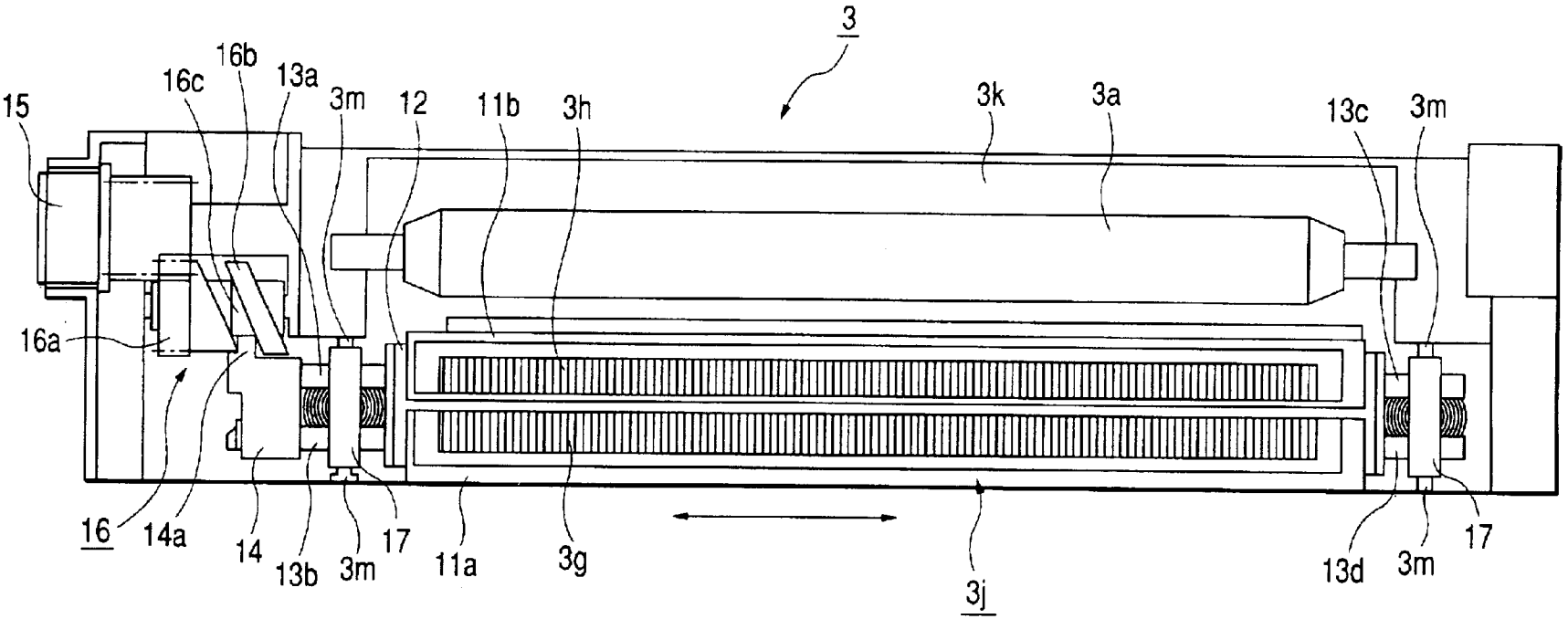
FIG. 18 is a schematic cross sectional view of one of the brush units of the fifth embodiment of charging means according to the invention.

Now, the fifth embodiment of developer charging device according to the invention will be described below. FIG. 16 is a schematic longitudinal cross sectional view of the fifth embodiment of developer charging device and FIGS. 17 and 18 are respectively a schematic front view of the fifth embodiment and a schematic cross sectional view of one of the brush units of the fifth embodiment. Configuration of brush units of developer charging device In each of the brush units 3*j* produced by unitizing a residual toner equalizing means (developer dispersing member) 3*g* and a toner charge control means (developer charging member) 3*h* as process means, the residual toner equalizing means 3*g* is rigidly held by a brush base 11*a*, which brush base 11*a* is by turn rigidly secured to a base frame 12 made of sheet metal typically by means of thermal caulking, screws or fastener tapes (dual-side adhesive tapes). Similarly, the toner charge control means 3*h* is rigidly supported by a brush base lib, which brush base lib is by turn rigidly secured to the base frame 12. Shafts 13*a*, 13*b*, 13*c*, 13*d* are extending outwardly from the longitudinal opposite ends of the base frame 12 and a transmission arm member 14 is fitted to the shafts 13*a*, 13*b* at a side (the drive side). The residual toner equalizing means 3*g* and the toner charge control means 3*h* are arranged with certain respective angles in such a way that they are directed toward the center of the photosensitive drum 2. As pointed out above, the brush unit 3*j* is formed by fitting the residual toner equalizing means 3*g* and the toner charge control means 3*h* to the base frame 12 so as to unitize them in such a way that the front ends of the brushes of the residual toner equalizing means 3*g* and the toner charge control means 3*h* contact the surface of the photosensitive drum 2.

Configuration of Brush Unit Drive Mechanism

The charging means 3 is provided at a longitudinal end thereof with a coupling gear 15 and a reciprocating cam 16 as drive transmission means, which coupling gear 15 and reciprocating cam 16 are supported by and rotatably held in mesh with the frame 3*k* of the charging means 3. The reciprocating cam 16 comprises a cam gear 16*a* that is engaged with the coupling gear 15 and a cam 16*b*, which cam gear 16*a* and cam 16*b* define a cam groove 16*c* and are linked to each other so that they rotate together. The cam groove 16*c* receives and is held in mesh with the projecting section 14*a* of the transmission arm member 14 of the brush unit 3*j*. Thus, as the process cartridges are mounted in the image forming apparatus main body, each of the couplers (not shown) of the apparatus main body comes into engagement with the couplers gear 15 of the corresponding one of the process cartridges so that rotary drive force is transmitted from the apparatus main body to the coupling gear 15 so as to drive the reciprocating cam 16 that is held in engagement with the coupling gear 15 to rotate.

As the reciprocating cam 16 rotates, the projecting section 14*a* of the transmission arm member 14 of the brush unit 3*j* that is held in mesh with the cam groove 16*c* is driven to slide in the cam groove 16*c* to reciprocate. In this embodiment, the brush unit 3*j* is adapted to reciprocate in a constant cycle period between 0.5 and 2.5 seconds with a stroke of 5 mm. At this time, the shafts 13*a*, 13*b*, 13*c*, 13*d* slide with the spacers 17, which are attitude maintaining means, as they are supported by the spacers 17 as shown in FIG. 18. The spacers 17 are engaged with the respective guide rails 3*m* arranged on the frame 3*k* and guided by the latter so that they may move toward and back from the center of the photosensitive drum 2 but cannot move in the longitudinal direction of the drum. Compression coil springs 18 are arranged in a compressed state between the respective spacers 17 and the frame 3*k* so that the brush unit is urged to abut the photosensitive drum 2 under pressure due to the spring force of the coil springs 18.

Restriction of Falls of Brush Bristles and Tilting Arrangement

In the above described brush unit 3*j*, the residual toner equalizing means 3*g* and the toner charge control means 3*h*, which are brush-shaped members, are directed to the center of the photosensitive drum 2. As the photosensitive drum 2 is driven to rotate in the direction indicated by the arrow in FIG. 16 (counterclockwise), the front ends of the brush sections of the brush unit 3*j* need to fall along the direction of the rotary movement of the photosensitive drum. If the front ends of the brush sections fall in a direction opposite to the direction of the rotary movement of the photosensitive drum 2, they abut the photosensitive drum in that direction in operation to counter the rotary movement of the photosensitive drum and consequently scrape off the residual toner from the surface of the photosensitive drum 2. Additionally, if the standing bristles of the brush sections fall from their bases, the density of the bristles contacting the photosensitive drum and the pressure under which the bristles push the photosensitive drum can be reduced in the related areas. Then, it will no longer possible to sufficiently charge the residual toner with electricity to give rise to a problem that toner adhere to and smear the contact charge member.

In view of such circumstances, the residual toner equalizing means 3*g* is provided with a fall restricting rib for restricting falls of bristles of the brush sections and a tilting rib for reliably tilting the bristles of the brush sections along the entire length of the photosensitive drum 2 in this embodiment.

The fall restricting rib 11*a*2 is integrally formed with a brush base 11*a* and is arranged downstream relative to the residual toner equalizing means 3*g*, which is a brush member, as viewed in the direction of the rotary movement of the photosensitive drum so that, when the residual toner equalizing means 3*g* falls due to the rotary movement of the photosensitive drum 2, it holds the bristles so that they may not fall from the base sections.

The bristles of the residual toner equalizing means 3*g* of this embodiment have a length of 5 mm and are held by 1 to 2 mm from the bases thereof by the fall restricting rib 11*a*2 so that the front end of the brush section of the residual toner equalizing means 3*g* may abut the photosensitive drum 2 constantly in an appropriate condition (in terms of the density of the bristles contacting the photosensitive drum and the pressure under which the bristles push the photosensitive drum).

The tilting rib 11*a*1 is arranged upstream relative to the residual toner equalizing means 3*g* as viewed in the direction of the rotary movement of the photosensitive drum so as to forcibly tilt the residual toner equalizing means 3*g* in a direction (the direction of the rotary movement of the photosensitive drum) along the entire longitudinal range thereof in such a way that it pushes the bristles of the brush section at a level elevated from the basis of the bristles by 1 to 2 mm.

Similarly, the toner charge control means 3*h* is also provided with a tilting rib 11*a*3 and a fall restricting rib 11*b*1.

With this arrangement, as shown in FIG. 16, as the brush unit 3*j* is assembled with the photosensitive drum 2, the front ends of the brush sections of the residual toner equalizing means 3*g* and the toner charge control means 3*h* abut the surface of the photosensitive drum 2 in such a condition that they are tilted in the direction of the rotary movement of the photosensitive drum 2 so as to avoid a situation where they abut the photosensitive drum and counter the rotary movement of the latter at the upstream side and, at the same time, the bristles of the residual toner equalizing means 3*g* and the toner charge control means 3*h* are restricted from falling at the downstream side in order to maintain the abutment of the residual toner equalizing means 3*g* and the toner charge control means 3*h* relative to the photosensitive drum 2 in a desired state.

<Embodiment 6>

Figure 19:
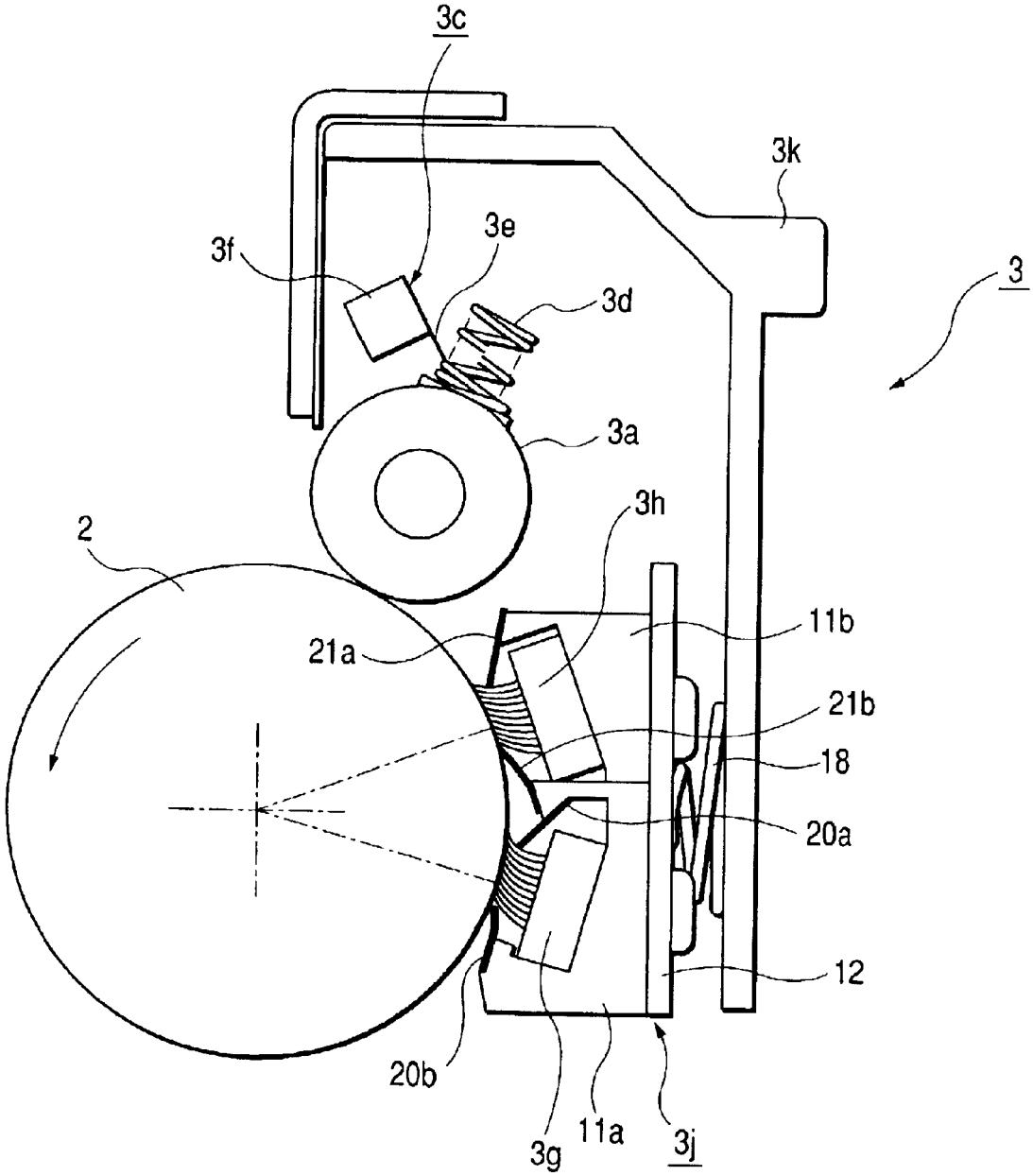
FIG. 19 is a schematic cross sectional view of one of the brush units of the sixth embodiment of charging means according to the invention.
Figure 20:
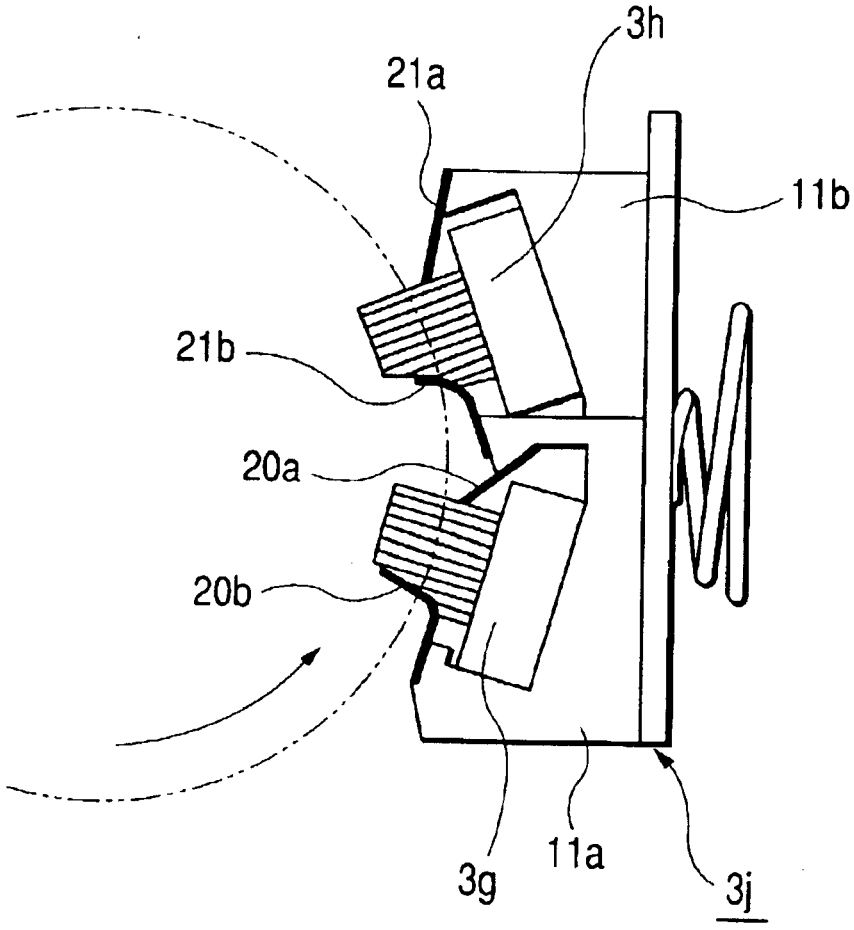
FIG. 20 is a schematic cross sectional view of the sixth embodiment of charging means according to the invention.

Now, the sixth embodiment of developer charging device according to the invention will be described below. FIG. 19 is a schematic cross sectional view of one of the brush units of the sixth embodiment of charging means according to the invention and FIG. 20 is a schematic cross sectional view of the charging means of the sixth embodiment.

In this embodiment, flexible sheet members are used to restrict falls of bristles and tilt the bristles of the brushes.

The flexible sheets are made of urethane, PET or the like. The fall restricting sheet 20*a* is bonded and rigidly secured at the base end thereof to the brush base 11*a* and held at the front end (free end) thereof close to the corresponding lateral side of the brush section of the residual toner equalizing means 3*g* in order to restrict falls of bristles. The tilting sheet 20*b* is bonded and rigidly secured at the base end thereof to the brush base 11*a* and warped and pressed at the front end side thereof against the corresponding lateral side of the brush section of the residual toner equalizing means 3*g* in order to tilt the bristles of the brush section of the latter. Thus, the front end of the brush section of the residual toner equalizing means 3*g* is tilted in the direction of the rotary movement of the photosensitive drum under the contact pressure of the sheet 20*b*.

Similarly, the toner charge control means 3*h* is also provided with a sheet 21*b* and a fall restricting sheet 21*a*.

With this arrangement, as shown in FIG. 19, as the brush unit 3*j* is assembled with the photosensitive drum 2, the front ends of the brush sections of the residual toner equalizing means 3*g* and the toner charge control means 3*h* are forced to abut the surface of the photosensitive drum 2 by the sheets 20*b*, 21*b* in such a condition that they are tilted in the direction of the rotary movement of the photosensitive drum 2 so as to avoid a situation where they abut the photosensitive drum and counter the rotary movement of the latter at the upstream side and, at the same time, the bristles of the residual toner equalizing means 3*g* and the toner charge control means 3*h* are tilted to contact the closely located front ends of the fall restricting sheets 21*a*, 21*b* and restricted from falling at the downstream side in order to maintain the abutment of the residual toner equalizing means 3*g* and the toner charge control means 3*h* relative to the photosensitive drum 2 in a desired state.

<Embodiment 7>

Figure 21:
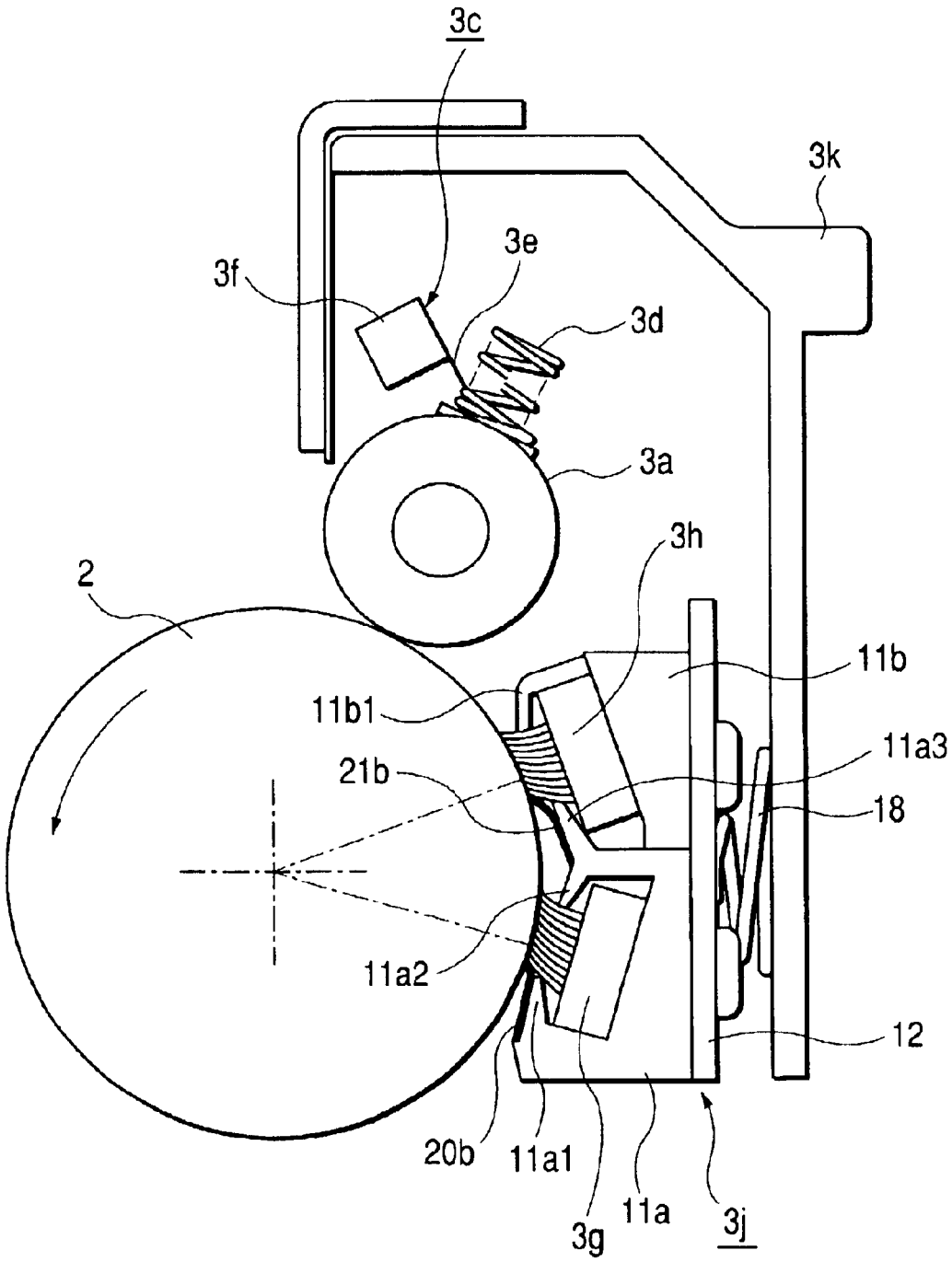
FIG. 21 is a schematic cross sectional view of one of the brush units of the seventh embodiment of charging means according to the invention.
Figure 22:
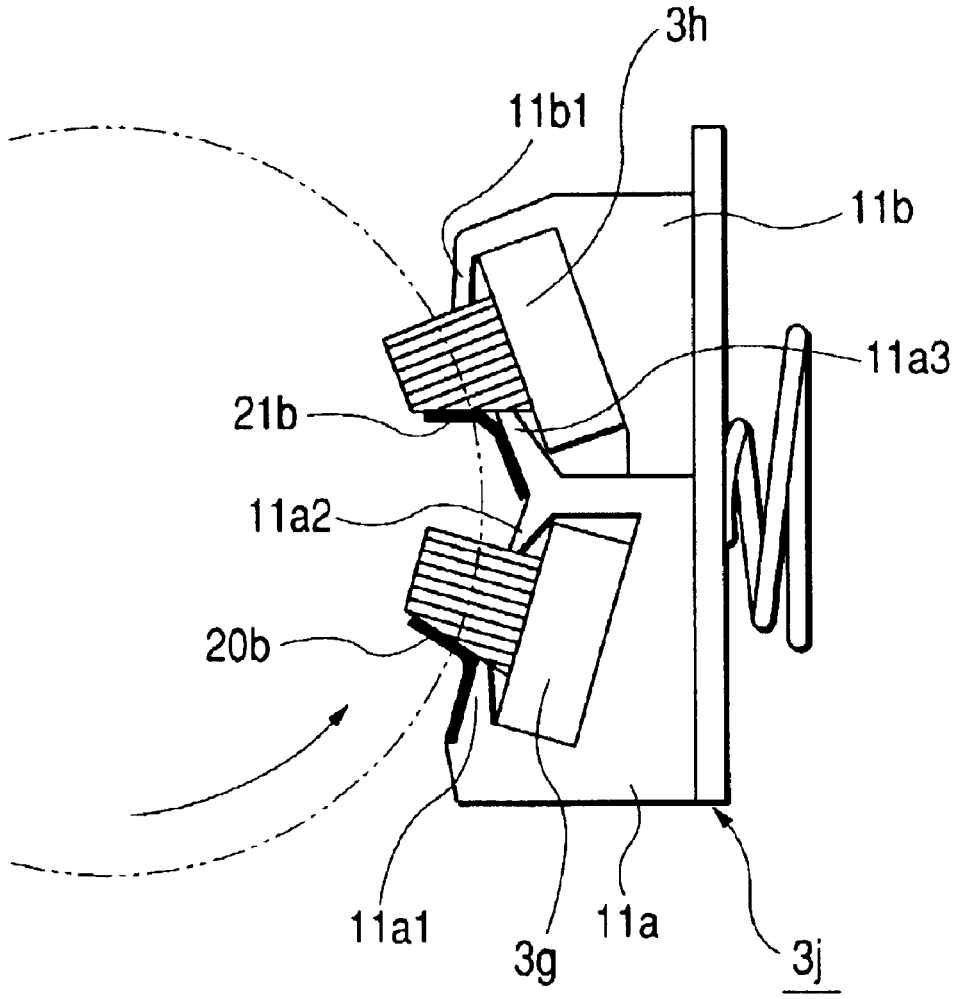
FIG. 22 is a schematic cross sectional view of the seventh embodiment of charging means according to the invention.

Now, the seventh embodiment of developer charging device according to the invention will be described below. FIG. 21 is a schematic cross sectional view of one of the brush units of the seventh embodiment of charging means according to the invention and FIG. 22 is a schematic cross sectional view of the charging means of the seventh embodiment.

In this embodiment, the arrangement for restricting falls of bristles and tilting bristles of the fifth embodiment and that of the sixth embodiment are combined in order to make the effect thereof more reliable.

The fall restricting rib 11*a*2 is integrally formed with a brush base 11*a* and is arranged downstream relative to the residual toner equalizing means 3*g*, which is a brush member, as viewed in the direction of the rotary movement of the photosensitive drum so that, when the residual toner equalizing means 3*g* falls due to the rotary movement of the photosensitive drum 2, it holds the bristles so that they may not fall from the base sections.

The tilting rib 11*a*1 is arranged upstream relative to the residual toner equalizing means 3*g* as viewed in the direction of the rotary movement of the photosensitive drum so as to forcibly tilt the residual toner equalizing means 3*g* in a direction (the direction of the rotary movement of the photosensitive drum) along the entire longitudinal range thereof in such a way that it pushes the bristles of the brush section at a level elevated from the basis of the bristles by 1 to 2 mm.

The sheet 20*b* is bonded and rigidly secured at the base end thereof to the tilting rib 11*a*1 and pressed at the front end side thereof against the corresponding lateral side of the brush section. Thus, the front end of the brush section is tilted in the direction of the rotary movement of the photosensitive drum under the contact pressure of the sheet 20*b*.

Similarly, the toner charge control means 3*h* is also provided with a tilting rib 11*a*3, a fall restricting rib 11*b*1 and a sheet 21*b*.

With this arrangement, as shown in FIG. 21, as the brush unit 3*j* is assembled with the photosensitive drum 2, the front ends of the brush sections of the residual toner equalizing means 3*g* and the toner charge control means 3*h* abut the surface of the photosensitive drum 2 in such a condition that they are tilted in the direction of the rotary movement of the photosensitive drum 2 so as to avoid a situation where they abut the photosensitive drum and counter the rotary movement of the latter at the upstream side and, at the same time, the bristles of the residual toner equalizing means 3*g* and the toner charge control means 3*h* are restricted from falling at the downstream side in order to maintain the abutment of the residual toner equalizing means 3*g* and the toner charge control means 3*h* relative to the photosensitive drum 2 in a desired state.

Thus, in this embodiment, each brush member is provided at the upstream side thereof as viewed in the moving direction of the image carrier with a rib and a sheet in order to push and tilt the brush member in the moving direction of the image carrier. Additionally, each brush member is provided at a position close to itself of the downstream side thereof as viewed in the moving direction of the image carrier with a rib for restricting falls of brush bristles. With this arrangement in a cleanerless type image forming apparatus, the plate-shaped brush members of the charging device whose front ends are held in abutment with the surface of the image carrier stably contact the image carrier to prevent a situation where fused toner adheres to the image carrier and defective charging and insufficient collection of residual toner occur due to a toner-contaminated charging roller. Additionally, residual toner on the image carrier is prevented from falling.

As described above, with the above described fifth through seventh embodiment, each brush member is tilted in the moving direction of the image carrier by arranging a rib and/or a flexible sheet that is held in contact with the brush member so as to avoid a situation where they abut the photosensitive drum and counter the rotary movement of the latter and the residual toner on the image carrier is scraped off by the brush members.

Additionally, each brush member is provided at the downstream side thereof as viewed in the moving direction of the image carrier with a rib and/or a flexible sheet that is held in contact with the brush member to restrict falls of bristles of the brush. With this arrangement, the brush members are held in abutment with the image carrier constantly in an appropriate condition as viewed in the moving direction of the image carrier (in terms of the density of the bristles contacting the photosensitive drum and the pressure under which the bristles push the photosensitive drum) so that the residual toner can be effectively charged.

Other Effects

1) The applicability of the present invention is not limited to process cartridges and image forming apparatus of the type. A developer charging device according to the invention provides a major improvement to conventional developer charging devices comprising one or more than one plate-like brush members whose front ends are held in abutment with the surface of the object to be electrically charged.

2) The image carrier of such a process cartridge or an image forming apparatus is not limited to an electrophotography type photosensitive body and may be a dielectric body adapted to electrostatic recording that is used for electrostatic recording processes.

3) The object to be electrically charged (image carrier) is not limited to a drum type revolving body. It may alternatively be an endless belt that is driven to rotate or a web-like body or a plate-shaped body that is driven to move.

The present invention is by no means limited to the above described embodiments, which may be altered or modified in many various different ways without departing from the spirit and scope of the present invention.

What is claimed is:

1. A developer charging device for charging developer with electricity, said device comprising:

a developer charging member arranged at a position downstream relative to a transfer means for transferring a developer image from an image carrier to an image receiving member and upstream relative to a charging means for electrically charging said image carrier as viewed in the moving direction of said image carrier and held in contact with said image carrier so as to electrically charge residual developer on said image carrier;

a reciprocating means for reciprocating said developer charging member in the direction of a generating line of said image carrier; and an attitude maintaining means for maintaining the attitude of said developer charging member relative to said image carrier regardless of reciprocation of said developer charging member by said reciprocating means, wherein said attitude maintaining means includes at least one spacer arranged in contact with said image carrier in order to maintain a positional relationship between said developer charging member and said image carrier.

2. A device according to claim 1, wherein said attitude maintaining means has an urging member for urging said spacer to make said spacer contact with said image carrier.

3. A device according to claim 1, further comprising:

a support member for supporting said developer charging member, said spacer being adapted to hold said support member so as to allow it to reciprocate in the direction of the generating line.

4. A device according to claim 3, wherein said developer charging member is a brush member and said device has a base section for holding said brush member, said support member supporting said base section so as to cause said brush member to be substantially directed to the center of rotation of said image carrier.

5. A device according to claim 1, wherein said spacer has an arc-shaped section in the contact area thereof contacting with said image carrier, said arc-shaped section showing a contour substantially matching the surface profile of said image carrier.

6. A device according to claim 1, wherein said spacer has a rotary member in the contact area thereof contacting with said image carrier.

7. A device according to claim 1, wherein said developer charging member is a brush member and said device has a base section for holding said brush member.

8. A device according to claim 7, wherein said brush member is adapted to bite said image carrier by 0.5 to 2.5 mm.

9. A device according to claim 7, further comprising:

a restricting member for restricting the base section of said brush member from falling toward the downstream as viewed in the moving direction of said image carrier.

10. A device according to claim 9, wherein said restricting member has a shape of a rib extending in the direction of a generating line.

11. A device according to claim 10, wherein said restricting member is longer than said brush member in the direction of a generating line.

12. A device according to claim 7, further comprising:

a tilting member arranged upstream relative to said brush member as viewed in the moving direction of said image carrier and adapted to tilt said brush member toward the downstream as viewed the moving direction of said image carrier.

13. A device according to claim 12, wherein said brush member is tilted by said tilting member contacting with and pushing said brush member and said tilting member has a shape of a rib extending in the direction of a generating line.

14. A device according to claim 13, wherein said tilting member is longer than said brush member in the direction of a generating line.

15. A device according to claim 12, wherein said tilting member is a flexible sheet.

16. A device according to claim 1, further comprising:

a dispersing member for dispersing residual developer on said image carrier, said dispersing member being arranged downstream relative to said transfer means and upstream relative to said developer charging member as viewed in the moving direction of said image carrier, said reciprocating means being adapted to reciprocate said dispersing member in the direction of a generating line of said image carrier;

said attitude maintaining means being adapted to maintain the attitude of said dispersing member relative to said image carrier regardless of reciprocation of said dispersing member by said reciprocating means.

17. A device according to claim 16, wherein said developer charging member is a first brush member and said dispersing member is a second brush member, said device having a first base section for holding said first brush member and a second base section for holding said second brush member.

18. A device according to claim 17, wherein said first and second brush members are adapted to bite said image carrier by 0.5 to 2.5 mm.

19. A device according to claim 1, further comprising:

a flexible member arranged in contact with said image carrier so as to prevent residual developer from leaking to the outside of said device.

20. A device according to claim 19, wherein said flexible member is longer than said developer charging member in the direction of a generating line.

21. A device according to claim 19, wherein said flexible member is a sheet member having a thickness between 0.025 and 0.3 mm.

22. A device according to claim 1, wherein said developer charging member charges residual developer to a proper charge polarity of developer.

23. A device according to claim 22, wherein said charging means has a charging member arranged in contact with said image carrier.

24. A developer charging device for charging developer with electricity, said device comprising:

a developer charging member arranged at a position downstream relative to a transfer means for transferring a developer image from an image carrier to an image receiving member and upstream relative to a charging means for electrically charging said image carrier as viewed in the moving direction of said image carrier and held in contact with said image carrier so as to electrically charge residual developer on said image carrier;

a dispersing member for dispersing residual developer on said image carrier, said dispersing member being arranged downstream relative to said transfer means and upstream relative to said developer charging member as viewed in the moving direction of said image carrier;

a reciprocating means for reciprocating said developer charging member and said dispersing member in the direction of a generating line of said image carrier; and an attitude maintaining means for maintaining the attitude of said developer charging member and said dispersing member relative to said image carrier regardless of reciprocation of said developer charging member by said reciprocating means, wherein said attitude maintaining means includes at least one spacer arranged in contact with said image carrier in order to maintain a positional relationship between said developer charging member and said image carrier and the positional relationship between said dispersing member and said image carrier.

25. A device according to claim 24, further comprising:

a support member for supporting said developer charging member and said dispersing member, said spacer being adapted to hold said support member so as to allow it to reciprocate in the direction of a generating line.

26. A device according to claim 25, wherein said developer charging member is a first brush member and said dispersing member is a second brush member, said device having a first base section for holding said first brush member and a second base section for holding said second brush member, said support member supporting said first and second base sections so as to cause said first and second brush members to be substantially directed to the center of rotation of said image carrier.

27. A device according to any one of claims 1 and 3 through 23, wherein said image carrier and said developer charging device are arranged in a process cartridge adapted to be removably mounted in an image forming apparatus main body.

28. A device according to any of claims 1 through 23, wherein said image carrier, said charging means, said transfer means and said developer charging device are arranged in an image forming apparatus along with a developing means for developing an electrostatic image formed on said image carrier by means of developer.

29. A developer charging device for charging developer with electricity, said device comprising:

a developer charging member arranged at a position downstream relative to a transfer means for transferring a developer image from an image carrier to an image receiving member and upstream relative to a charging means for electrically charging said image carrier as viewed in a moving direction of said image carrier and held in contact with said image carrier so as to electrically charge residual developer on said image carrier;

a reciprocating means for reciprocating said developer charging member in a direction of a generating line of said image carrier; and a spacer arranged in contact with said image carrier in order to maintain a positional relationship between said developer charging member and said image carrier regardless of reciprocation of said developer charging member by said reciprocating means.

30. A device according to claim 29, further comprising:

an urging member for urging said spacer to urge said spacer into contact with said image carrier.

31. A device according to claim 29, further comprising:

a support member for supporting said developer charging member, said spacer being adapted to hold said support member so as to allow said support member to reciprocate in the direction of the generating line.

32. A device according to claim 29, wherein said spacer includes an arc-shaped section having a contact area thereof contacting with said image carrier, said arc-shaped section having a contour substantially matching a surface profile of said image carrier.

33. A device according to claim 29, wherein said spacer including a rotary member in the contact area thereof contacting with said image carrier.

34. A developer charging device for charging developer with electricity, said device comprising:

a developer charging member arranged at a position downstream relative to a transfer means for transferring a developer image from an image carrier to an image receiving member and upstream relative to a charging means for electrically charging said image carrier as viewed in the moving direction of said image carrier and held in contact with said image carrier so as to electrically charge residual developer on said image carrier;

a dispersing member for dispersing residual developer on said image carrier, said dispersing member being arranged downstream relative to said transfer means and upstream relative to said developer charging member as viewed in a moving direction of said image carrier;

a reciprocating means for reciprocating said developer charging member and said dispersing member in the direction of a generating line of said image carrier; and a spacer arranged in contact with said image carrier in order to maintain a positional relationship between said developer charging member and said image carrier and the positional relationship between said dispersing member and said image carrier.

35. A device according to claim 34, further comprising:

an urging member for urging said spacer to urge said spacer into contact with said image carrier.

36. A device according to claim 34, further comprising:

a support member for supporting said developer charging member, said spacer being adapted to hold said support member so as to allow said support member to reciprocate in the direction of the generating line.

37. A device according to claim 34, wherein said spacer includes an arc-shaped section in a contact area thereof contacting with said image carrier, said arc-shaped section having a contour substantially matching a surface profile of said image carrier.

38. A device according to claim 34, wherein said spacer includes a rotary member in the contact area contacting with said image carrier.

* * * * *

UNITED STATES PATENT AND TRADEMARK OFFICE

CERTIFICATE OF CORRECTION

PATENT NO. : 6,754,461 B2
DATED : June 22, 2004
INVENTOR(S) : Nobuharu Hoshi et al.

It is certified that error appears in the above-identified patent and that said Letters Patent is hereby corrected as shown below:

Title page,
Item [73], Assignee, "Canon Kabushiki Kaisha, Tokyo (JP)" should read -- Canon Kabushiki Kaisha, Tokyo (JP) --.
Item [57], ABSTRACT,
Line 2, "member" should read -- member, --; and
Line 5, "device" should read -- device for --.

Column 5,
Line 26, "transfer-material" should read -- transfer material --.

Column 6,
Line 26, "held" should read -- is held --; and
Line 41, "free" should read -- a free --.

Column 11,
Line 47, "same" should read -- the same --.

Column 12,
Line 26, "most" should read -- furthest --;
Line 49, "The toner" should read -- ¶The toner --.

Column 13,
Line 18, "a like" should read -- side --.

Column 14,
Line 55, "side-" should read -- side --.

Column 16,
Line 9, "member," should read -- members, --;
Line 22, "movable" should read -- movably --; an
Line 56, "bit" should read -- bite --.

Column 21,
Line 57, "made" should read -- made to --; and
Line 67, "possible" should read -- be possible --.

UNITED STATES PATENT AND TRADEMARK OFFICE

CERTIFICATE OF CORRECTION

PATENT NO. : 6,754,461 B2
DATED : June 22, 2004
INVENTOR(S) : Nobuharu Hoshi et al.

It is certified that error appears in the above-identified patent and that said Letters Patent is hereby corrected as shown below:

Column 22,
Line 37, “embodiment. Configuration of” should read -- embodiment. ¶Configuration Of --;
Line 38, “brush units of developer charging device” should read -- Configuration of Brush Units of Developer Charging Device --; and
Line 48, “lib,” (both occurrences) should read -- 11b, --.

Column 23,
Line 54, “possible” should read -- be possible --.

Column 26,
Line 18, “embodiment,” should read -- embodiments, --.

Column 27,
Line 61, “viewed” should read -- viewed in --.

Column 28,
Line 28, “said tilting” should be deleted;
Line 14, “carrier;” should read -- carrier; and --;
Line 39, “said developer” should be deleted; and
Line 40, “charging”should read -- said deveoper charging --.

Column 29,
Line 23, “member,” should read -- member, and --;
Line 28, “and 3” should be deleted;
Line 29, “through 23,” should read -- through 26, --; and
Line 34, “claims 1 through 23,” should read -- claims 1 through 26, --.

UNITED STATES PATENT AND TRADEMARK OFFICE

CERTIFICATE OF CORRECTION

PATENT NO. : 6,754,461 B2
DATED : June 22, 2004
INVENTOR(S) : Nobuharu Hoshi et al.

It is certified that error appears in the above-identified patent and that said Letters Patent is hereby corrected as shown below:

Column 30,
Line 6, “member, said” should read -- members, ¶said --;
Line 14, “including” should read -- includes --; and
Line 47, “member, said” should read -- member, ¶said --.

Signed and Sealed this

Thirty-first Day of May, 2005

JON W. DUDAS
*Director of the United States Patent and Trademark Office*